US008235610B2

(12) United States Patent
Saito et al.

(10) Patent No.: US 8,235,610 B2
(45) Date of Patent: Aug. 7, 2012

(54) PRINTING APPARATUS AND CONVEYANCE CONTROL METHOD

(75) Inventors: Hiroyuki Saito, Yokohama (JP); Haruyuki Yanagi, Machida (JP); Kentaro Onuma, Yokohama (JP); Tetsuya Ishikawa, Yokohama (JP); Yuichiro Suzuki, Yokohama (JP); Hiroyuki Kakishima, Kawasaki (JP); Michiharu Shoji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 677 days.

(21) Appl. No.: 11/842,553

(22) Filed: Aug. 21, 2007

(65) Prior Publication Data

US 2008/0050165 A1 Feb. 28, 2008

(30) Foreign Application Priority Data

Aug. 23, 2006 (JP) ..... 2006-227017

(51) Int. Cl.
*B41J 13/03* (2006.01)
*B41J 13/00* (2006.01)

(52) U.S. Cl. ..... 400/76; 347/104; 400/582; 400/578

(58) Field of Classification Search ..... 400/582, 400/76, 578, 634, 636; 347/104
See application file for complete search history.

(56) References Cited

U.S. PATENT DOCUMENTS

| | | | | |
|---|---|---|---|---|
| 5,602,571 | A | 2/1997 | Suda et al. | |
| 6,095,703 | A | 8/2000 | Tanaka et al. | |
| 6,168,333 | B1 | 1/2001 | Merz et al. | |
| 6,655,865 | B2 | 12/2003 | Yanagi et al. | 400/705 |
| 6,685,370 | B2 * | 2/2004 | Hiramatsu | 400/640 |
| 6,761,425 | B2 | 7/2004 | Kawaguchi | 347/16 |
| 7,014,378 | B2 | 3/2006 | Saito et al. | 400/582 |
| 7,021,737 | B2 | 4/2006 | Yamada | |
| 7,055,949 | B2 | 6/2006 | Ohashi | |
| 7,093,917 | B2 | 8/2006 | Yamada | 347/19 |
| 7,189,018 | B2 | 3/2007 | Cercos et al. | |

(Continued)

FOREIGN PATENT DOCUMENTS

CN 1060432 4/1992

(Continued)

OTHER PUBLICATIONS

Official Action (Translation), dated May 8, 2009, issued by The Chinese Patent Office, in Chinese Patent Application No. 200710146593.2.

(Continued)

*Primary Examiner* — Matthew G Marini
(74) *Attorney, Agent, or Firm* — Fitzpatrick, Cella, Harper & Scinto

(57) ABSTRACT

This invention relates to a printing apparatus and a conveyance control method capable of allowing even an arrangement having a plurality of conveyance rollers in a printing medium conveyance path to accurately control conveyance of a printing medium. According to this invention, a first encoder detects a conveyance amount by a first conveyance roller, provided in a conveyance path, for conveying a printing medium. A second encoder detects a conveyance amount by a second conveyance roller provided in the conveyance path in the conveyance direction of the printing medium at the downstream side of the first conveyance roller for conveying the printing medium. On the other hand, a signal output from the first or second encoder is selected on the basis of the position of the printing medium on the conveyance path. Conveyance of the printing medium is controlled on the basis of the selected output signal.

19 Claims, 17 Drawing Sheets

U.S. PATENT DOCUMENTS

| | | | | |
|---|---|---|---|---|
| 7,195,239 | B2 | 3/2007 | Saito et al. | 271/256 |
| 7,290,763 | B2 | 11/2007 | Suzuki et al. | 271/9.13 |
| 7,367,733 | B2 * | 5/2008 | Bedzyk et al. | 400/625 |
| 7,401,913 | B2 * | 7/2008 | Nishiberi et al. | 347/104 |
| 7,410,167 | B2 | 8/2008 | Koga et al. | |
| 7,494,204 | B2 | 2/2009 | Otsuki | |
| 7,597,322 | B2 * | 10/2009 | Suzuki et al. | 271/265.02 |
| 2001/0055054 | A1 | 12/2001 | Kosaka et al. | |
| 2003/0006550 | A1 * | 1/2003 | Chujo et al. | 271/262 |
| 2003/0053828 | A1 * | 3/2003 | Yagi et al. | 399/301 |
| 2005/0163553 | A1 * | 7/2005 | Cercos et al. | 400/636 |
| 2006/0033943 | A1 | 2/2006 | Yanagi | 358/1.13 |
| 2007/0007711 | A1 | 1/2007 | Suzuki et al. | 271/121 |
| 2007/0172296 | A1 | 7/2007 | Igarashi | |
| 2008/0006984 | A1 | 1/2008 | Kakishima | 271/109 |
| 2008/0008513 | A1 | 1/2008 | Kakishima et al. | 400/579 |

FOREIGN PATENT DOCUMENTS

| | | |
|---|---|---|
| CN | 1496854 | 5/2004 |
| EP | 1 666 263 A | 6/2006 |
| JP | 08-142431 | 6/1996 |
| JP | 11-049400 | 2/1999 |
| JP | 2002-225370 | 8/2002 |
| JP | 2002-254736 | 9/2002 |
| JP | 2002-361958 | 12/2002 |
| JP | 2004-122362 | 4/2004 |
| JP | 2004-202962 | 7/2004 |
| JP | 2005-007817 | 1/2005 |
| JP | 2005-131928 | 5/2005 |
| JP | 2005-132028 | 5/2005 |
| JP | 2006-82425 | 3/2006 |
| JP | 2006-103811 | 4/2006 |
| JP | 2006-130857 | 5/2006 |
| JP | 2006-170745 | 6/2006 |
| JP | 2007-197148 A | 8/2007 |

OTHER PUBLICATIONS

Official Letter/Search Report, issued by the European Patent Office, on Nov. 26, 2007, in European Patent Application No. 07016478.5.

Office Action issued by the Japanese Patent Office, dated Jun. 6, 2011, in Japanese Patent Application No. 2006-227017.

* cited by examiner

PRINTING APPARATUS AND CONVEYANCE CONTROL METHOD

BACKGROUND OF THE INVENTION

1. Field of the Invention

The present invention relates to a printing apparatus and a conveyance control method. Particularly, the present invention relates to a printing apparatus and a conveyance control method which perform accurate conveyance control even when, e.g., the leading edge or trailing edge of a printing medium enters between or passes through conveyance rollers.

2. Description of the Related Art

Recent printing apparatuses such as printers use not only plain paper but also printing media such as photo special paper to print photo images in many occasions. In particular, an inkjet printer which uses smaller ink droplets for printing can obtain an image quality equal to or higher than a film photo.

Accordingly, conveyance of printing media is also required to be more accurate. Conveyance rollers use high precision rollers with, e.g., a grindstone coating on a metal shaft. A DC motor used to drive the conveyance rollers is controlled by a cord wheel and an encoder sensor provided coaxially, thereby simultaneously ensuring high accuracy and high-speed conveyance.

Only one pair of conveyance rollers does not suffice for accurately printing an image up to the trailing edge of a printing medium. To implement, e.g., marginless print, some proposed arrangements have another pair of conveyance rollers downstream in the printing medium conveyance direction. In such an arrangement, however, when the trailing edge of a printing medium passes through a conveyance roller pair upstream in the conveyance direction, the conveyance amount may change, resulting in density unevenness in the image. To ensure a conveyance accuracy up to the trailing edge of a printing medium, the nozzles of the printhead to be used for printing on the trailing edge part of a printing medium are restricted, thereby reducing the conveyance amount. In addition to the restriction on the nozzle use of the printhead, conveyance of the trailing edge part of the printing medium is controlled to maintain the printing quality (Japanese Patent Laid-Open No. 2002-225370). The mechanical accuracy of the conveyance roller pair downstream in the conveyance direction is also increased to ensure the conveyance accuracy.

In recent years, the need for further improving the printed image quality and the printing speed has risen more and more. To meet these requirements, the print width of a printhead increases, the number of passes of multipass printing decreases, and the printing medium conveyance length of each pass printing increases. To attain a higher image quality, ink droplets to be used in printing become smaller. This also indicates that it is necessary to more accurately convey a printing medium.

In the above-described prior art, however, printing on the trailing edge part of a printing medium is performed without sufficiently exploiting the performance of the printhead, creating a bottleneck for high-speed printing of a market demand.

More specifically, in a printer having another conveyance roller pair downstream in the conveyance direction of a printing medium to cope with, e.g., marginless printing, when the trailing edge of a printing medium passes through the conveyance rollers on the upstream side, and only the conveyance rollers on the downstream side convey the printing medium, it is affected by, e.g., idler gear driving. This makes it difficult to ensure conveyance accuracy. To ensure the accuracy, the number of nozzles in use by the printhead must be restricted. This is a great obstacle in speeding up printing.

SUMMARY OF THE INVENTION

Accordingly, the present invention is conceived as a response to the above-described disadvantages of the conventional art.

For example, a printing apparatus and a conveyance control method according to this invention are capable of allowing even an arrangement having a plurality of conveyance rollers in a printing medium conveyance path to accurately control conveyance of a printing medium.

According to one aspect of the present invention, preferably, there is provided a printing apparatus (1) for printing on a printing medium using a printhead comprising: a first conveyance roller (36) for conveying the printing medium; a second conveyance roller (40), provided at a downstream side from the first conveyance roller with respect to a conveyance direction of the printing medium, for conveying the printing medium; a first encoder (362, 363) for outputting a signal in accordance with a rotation of the first conveyance roller; a second encoder (402, 403) for outputting a signal in accordance with a rotation of the second conveyance roller; and conveyance control means for controlling conveyance of the printing medium on the basis of the signal output from either the first encoder or the second encoder in accordance with a position on a conveyance path of the printing medium.

According to another aspect of the present invention, preferably, there is provided a conveyance control method of a printing apparatus (1) for printing on a printing medium using a printhead, the method comprising: a first signal output step of outputting a first signal in accordance with a rotation of a first conveyance roller (36) provided in a conveyance path of the printing medium; a second signal output step of outputting a second signal in accordance with a rotation of a second conveyance roller (40) provided in the conveyance path at a downstream side from the first conveyance roller with respect to the conveyance direction of the printing medium; a selection step of selecting one of the first signal and the second signal on the basis of a position of the printing medium on the conveyance path; and a conveyance control step of controlling conveyance of the printing medium on the basis of the signal selected in the selection step.

The invention is particularly advantageous since an encoder is provided for each of two conveyance rollers provided in the conveyance path of a printing medium, and conveyance control of the printing medium is performed by selectively using an output signal from one of the encoders on the basis of the position of the printing medium on the conveyance path. This allows implementation of more accurate conveyance control and consequently high-quality image printing.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
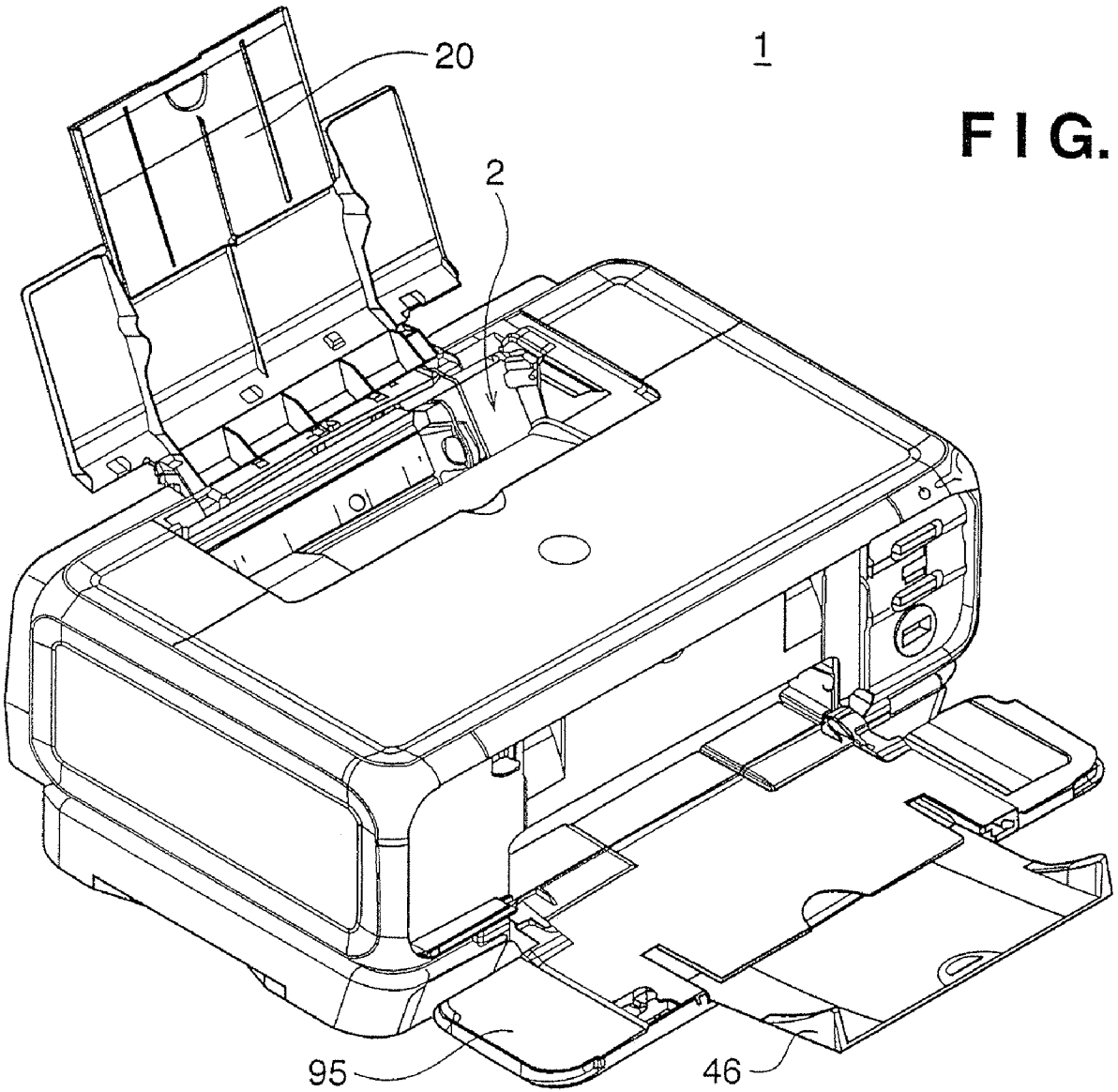
FIG. 1 is a schematic perspective view of a printing apparatus of a typical embodiment of the present invention, which prints by using an inkjet printhead.

FIG. 1 is a schematic perspective view of a printing apparatus of a typical embodiment of the present invention, which prints using an inkjet printhead.

Figure 2:
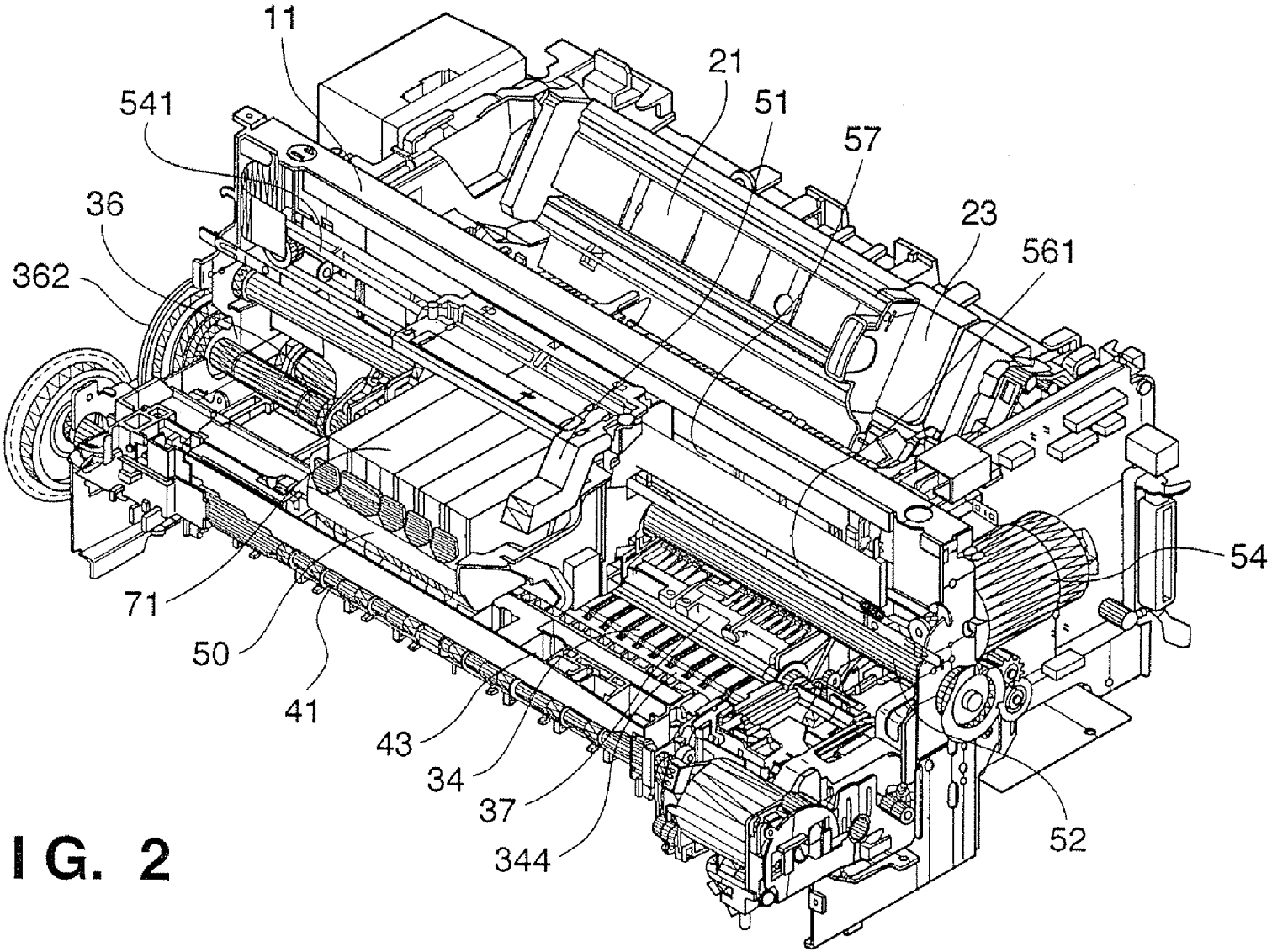
FIG. 2 is a schematic perspective view showing the internal structure of the printing apparatus in FIG. 1 without the outer case.

FIG. 2 is a schematic perspective view showing the internal structure of the printing apparatus in FIG. 1 without the outer case. For example, the printing apparatus forms an image on a printing medium by repeatedly conveying the printing medium by a predetermined amount and scanning a carriage with a printhead.

Figure 3:
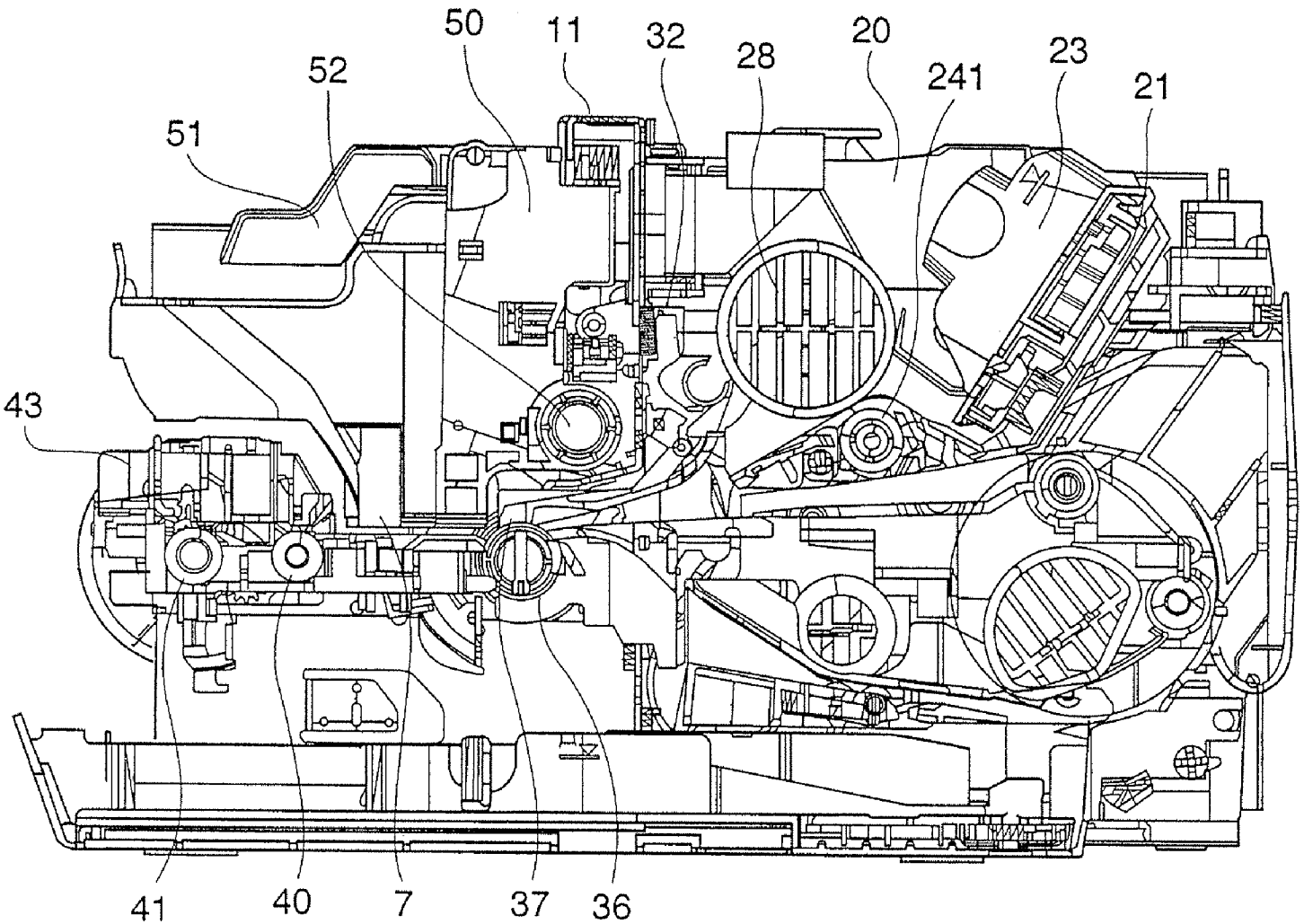
FIG. 3 is a side sectional view showing a printing medium conveyance mechanism in the internal structure of the printing apparatus in FIG. 2.

FIG. 3 is a side sectional view showing a printing medium conveyance mechanism in the internal structure of the printing apparatus in FIG. 2.

Figure 4:
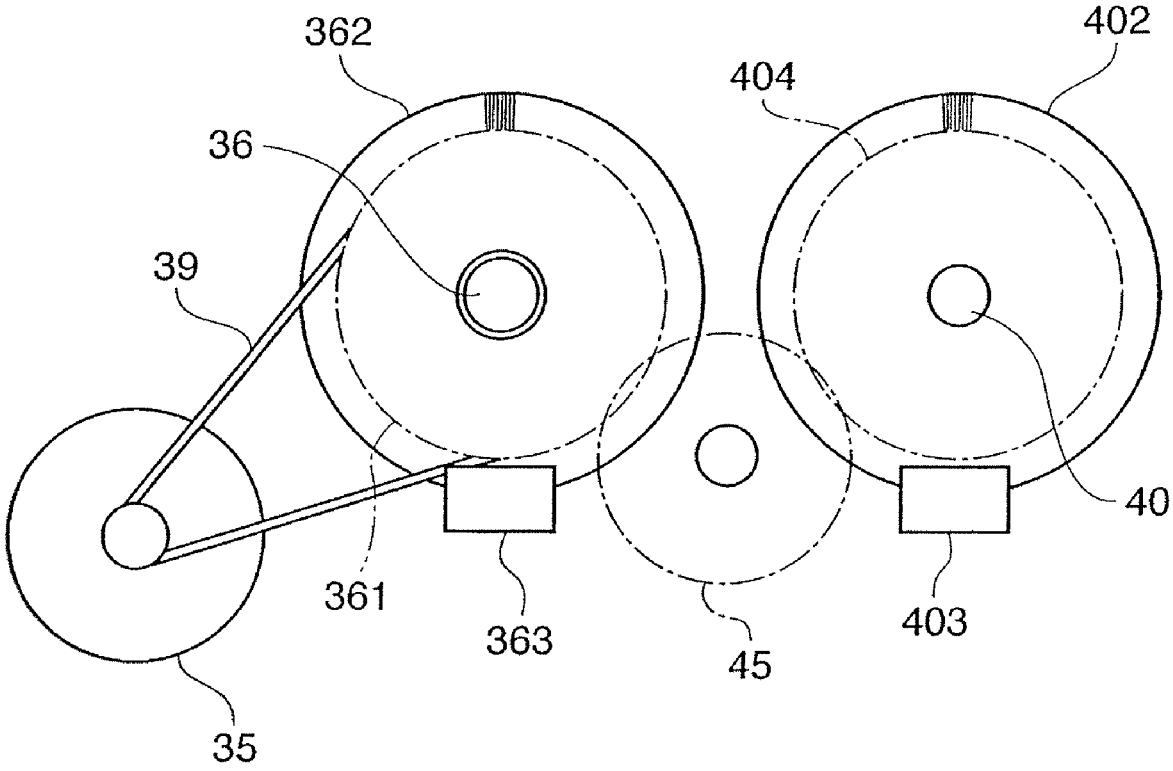
FIG. 4 is a side sectional view showing a conveyance roller and a discharge roller which are included in the printing medium conveyance mechanism and have encoders, respectively.

FIG. 4 is a side sectional view showing a conveyance roller and a discharge roller which are included in the printing medium conveyance mechanism and have encoders, respectively.

The arrangement of the printing apparatus will be described next with reference to FIGS. 1 to 4.

A printing apparatus 1 shown in FIGS. 1 to 4 includes a feeding portion, conveyance portion, carriage portion, and discharge portion. The schematic arrangements of these portions will be described sequentially.

(A) Feeding Portion

A feeding portion 2 shown in FIG. 1 is designed to stack sheet-like printing media (not shown) such as cut sheets on a pressure plate 21, as shown in FIG. 3. In the feeding portion 2, the pressure plate 21, a feed roller 28 to feed a printing medium, and a separation roller 241 to separate each printing medium are attached to a base 20.

A feed tray (not shown) to hold the stacked printing media is attached to the base 20 or housing. The slidably retractable feed tray is pulled out for use.

The feed roller 28 is columnar and has an arc-shaped section. A motor shared by a cleaning unit provided in the feeding portion 2 transmits a driving force to the feed roller 28 via a driving transmitting gear (not shown) and a planet gear (not shown).

A movable side guide 23 is provided on the pressure plate 21 to limit the stack position of printing media. The pressure plate 21 can rotate about a rotating shaft coupled to the base 20. A platen spring (not shown) biases the pressure plate 21 to the feed roller 28. The pressure plate 21 has, on its part facing the feed roller 28, a separation sheet (not shown) made of a material with a large friction coefficient, e.g., artificial leather to prevent erroneous multiple sheets conveyance when the stacked printing media are going to run out. The pressure plate 21 can abut against the feed roller 28 or separate from it via a pressure plate cam (not shown).

The separation roller 241 has a clutch spring (not shown). With a predetermined load or more, the attachment portion of the separation roller 241 can rotate.

In a normal standby state, the stack port is closed not to feed the stacked printing media into the printing apparatus. When feeding starts in this state, the motor is driven to make the separation roller 241 abut against the feed roller 28. The pressure plate 21 also abuts against the feed roller 28. Feeding of the printing media starts in this state. Only a predetermined number of printing media are fed to a nip portion formed by the feed roller 28 and the separation roller 241. The fed printing media are separated at the nip portion. Only the printing medium at the top is fed into the printing apparatus.

When the printing medium reaches a conveyance roller 36 and pinch rollers 37, the pressure plate cam (not shown) returns the pressure plate 21 to the initial position. At this time, the printing medium that has reached the nip portion formed by the feed roller 28 and the separation roller 241 can return to the stack position.

(B) Conveyance Portion

The conveyance portion is attached to a chassis 11 made of a bent metal sheet. The conveyance portion has the conveyance roller 36 for conveying a printing medium, and a PE sensor 32. The conveyance roller 36 is made of a metal shaft with a coating of ceramic micro-particles. The conveyance roller 36 is received by bearings at its metal parts of both ends and attached to the chassis 11. A conveyance roller tension spring (not shown) is inserted between the conveyance roller 36 and each bearing to bias the conveyance roller 36 and apply a predetermined load to it during rotation so that stable conveyance is possible.

The plurality of pinch rollers 37 are abut against and follow the conveyance roller 36. A pinch roller holder (not shown) holds the pinch rollers 37. A pinch roller spring (not shown) biases the pinch rollers 37 to press them against the conveyance roller 36 so that a printing medium conveyance force is generated. The pinch rollers 37 rotate about the rotating shaft of the pinch roller holder, which is attached to the bearings of the chassis 11. A platen 34 is disposed at the entrance of the conveyance portion where a printing medium arrives. The platen 34 is attached to the chassis 11 and positioned.

In the above arrangement, a printing medium fed to the conveyance portion is guided by the pinch roller holder (not shown) and a paper guide flapper and fed to the roller pair of the conveyance roller 36 and pinch rollers 37. At this time, the PE sensor 32 detects the leading edge of the conveyed printing medium whereby the print position of the printing medium is determined. As a conveyance motor (not shown) rotates the pair of rollers 36 and 37, the printing medium is conveyed on the platen 34. Ribs serving as a conveyance reference plane are formed on the platen 34 to manage the gap to the printhead and suppress wave of the printing medium together with the discharge portion to be described later.

As shown in FIG. 4, a conveyance motor 35 formed from a DC motor transmits its rotating force to a pulley 361 provided coaxially on the conveyance roller 36 via a timing belt 39, thereby driving the conveyance roller 36. A cord wheel 362 with markings formed at a pitch of 150 to 300 lpi is provided coaxially on the conveyance roller 36 to detect the conveyance amount by the conveyance roller 36. An encoder sensor 363 to read the markings is attached to the chassis 11 to be adjacent to the cord wheel 362.

As described above, a characteristic feature of this embodiment is to include a plurality of cord wheels and encoder sensors in a single mechanism, and convey a printing medium P while changing the object of control for each conveyance area of the printing medium P on the basis of the outputs from the plurality of encoder sensors in conveyance control using one conveyance motor serving as a driving source.

This arrangement is advantageous in its low cost because only one driving source is used. This conveyance mechanism can directly control a necessary object of control in an area where accurate control is necessary. Since a chain of drives is formed, the behavior in switching the object of control stabilizes. Unlike an arrangement having a plurality of driving sources, advanced synchronous control of a plurality of rollers is unnecessary.

A printhead 7 used for forming an image on the basis of image information is provided downstream in the printing medium conveyance direction of the conveyance roller 36.

As the printhead 7, an inkjet printhead including color ink tanks 71 that are individually exchangeable is used. The printhead 7 discharges ink from nozzles to form an image on a printing medium as the ink film-boils upon receiving heat from, e.g., a heater and creates bubbles which grow or shrink to change the pressure. At this time, the platen 34 holds the printing medium to maintain a predetermined distance between its print surface and the nozzles.

An absorbent material 344 is provided on the platen 34 to absorb ink overflowing from the edge of a printing medium in full print (marginless print). The absorbent material 344 absorbs ink overflowing from all four edges of a printing medium.

(C) Carriage Portion

A carriage portion 5 has a carriage 50 to which the printhead 7 is attached. A guide shaft 52 that reciprocally scans in a perpendicular direction (different direction) to the printing medium conveyance direction and a guide rail (not shown) which holds the rear end of the carriage 50 to maintain the gap between the printhead 7 and a printing medium support the carriage 50. The guide shaft 52 is attached to the chassis 11. The guide rail is integrated with the chassis 11.

A carriage motor 54 attached to the chassis 11 drives the carriage 50 via a timing belt 541. The timing belt 541 connects to the carriage 50 via a damper made of, e.g., rubber and reduces the density unevenness in images by attenuating vibrations of the carriage motor 54 and the like. A code strip 561 with markings formed at a pitch of 150 to 300 lpi is provided parallel to the timing belt 541 to detect the position of the carriage 50. An encoder sensor (not shown) to read the markings is provided on a carriage substrate (not shown) provided in the carriage 50. The carriage 50 also has a flexible substrate 57 to transmit various kinds of control signals and print signals from a control circuit (to be described later) to the printhead 7.

A head set lever 51 is provided to fix the printhead 7 to the carriage 50. The printhead 7 is fixed to the carriage 50 by turning the head set lever 51 about its fulcrum.

To form an image on a printing medium, the pair of rollers 36 and 37 convey a printing medium to the ink discharge position of the printhead 7 along the printing medium conveyance direction. Simultaneously, the carriage motor 54 moves the carriage 50 to the ink discharge position along the carriage moving direction. The printhead 7 discharges ink to the printing medium in accordance with a control signal from the control circuit, thereby forming an image.

(D) Discharge Portion

The discharge portion includes two discharge rollers 40 and 41, a spur (not shown) that abuts against the discharge rollers 40 and 41 at a predetermined pressure and rotates with them, and a series of gears to transmit the driving force of the conveyance roller to the discharge rollers 40 and 41. The discharge rollers 40 and 41 are attached to the platen 34. The discharge roller 40 has a plurality of rubber parts on its metal shaft.

As shown in FIG. 4, the discharge roller 40 is driven as the drive of the conveyance roller 36 acts, via an idler gear 45, on a discharge roller gear 404 directly connected to the discharge roller 40. The discharge roller 41 provided downstream of the discharge roller 40 in the printing medium conveyance direction is made of a resin. Driving force to the discharge roller 41 is transmitted from the discharge roller 40 via another idler gear. A cord wheel 402 with markings formed at a pitch of 150 to 300 lpi is provided coaxially on the discharge roller 40 to detect the conveyance amount by the discharge roller 40. An encoder sensor 403 to read the markings is attached to the chassis 11 to be adjacent to the cord wheel 402.

The spur is attached to a spur holder 43.

With the above-described arrangement, the printing medium printed by the printhead 7 is pinched at the nip between the spur and the discharge roller 41, conveyed, and discharged to a discharge tray 46. The discharge tray 46 is retractable into a front cover 95. For use, the discharge tray 46 is pulled out. The discharge tray 46 has an ascending slope and vertical projections at two ends to easily stack discharged printing media and prevent friction of printed surfaces.

Figure 5:
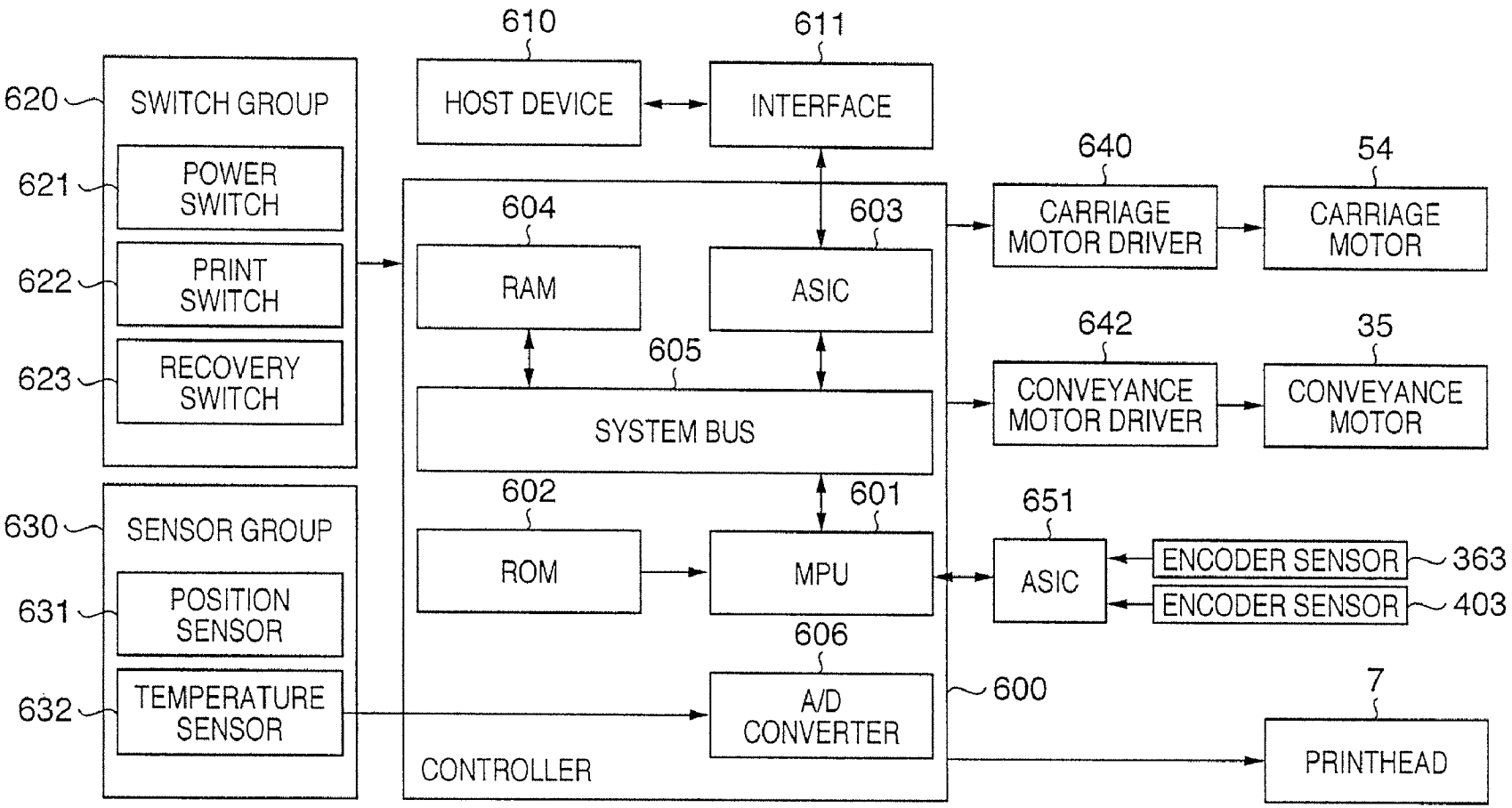
FIG. 5 is a block diagram showing the control arrangement of the printing apparatus shown in FIGS. 1 to 4.

FIG. 5 is a block diagram showing the control arrangement of the printing apparatus shown in FIGS. 1 to 4.

As shown in FIG. 5, a controller 600 has an MPU 601, ROM 602, ASIC (Application Specific Integrated Circuit) 603, RAM 604, and A/D converter 606. The ROM 602 stores programs corresponding to control sequences to be described later, necessary tables, and other fixed data. The ASIC 603 generates control signals to control the carriage motor 54, conveyance motor 35, and printhead 7. The RAM 604 has, e.g., an image data rasterization area and a work area for program execution. The MPU 601, ASIC 603, and RAM 604 connect to each other via a system bus 605 to exchange data. The A/D converter 606 receives analog signals from a sensor group to be described below, A/D-converts them, and supplies the A/D converted digital signals to the MPU 601.

Referring to FIG. 5, a computer (or a reader for image reading or a digital camera) 610 serving as an image data supply source is generically called a host device. The host device 610 and the printing apparatus 1 exchange image data, commands, and status signals via an interface (I/F) 611.

A switch group 620 includes a power switch 621, a print switch 622 that gives the instruction to start printing, and a recovery switch 623 that gives the instruction to activate a process (recovery process) to maintain high ink discharge performance of the printhead 7. The printing apparatus receives an operator's instruction inputs from these switches. A sensor group 630 includes a position sensor 631 such as a photocoupler to detect a home position, and a temperature sensor 632 provided at an appropriate position of the printing apparatus to detect the ambient temperature.

The encoder sensors 363 and 403 read the markings on the cord wheels 362 and 402 provided on the conveyance roller 36 and discharge roller 40, respectively, and generate encoder signals (analog signals). Each of the encoder sensors 363 and 403 generates an edge signal by detecting the signal edge of the generated encoder signal and A/D-converts the edge signal to generate a digital pulse signal. The markings on the cord wheels 362 and 402 are formed at a predetermined pitch. For this reason, the pulse signals are generated at a predetermined period as long as the conveyance roller 36 and discharge roller 40 normally rotate at a predetermined rotational speed.

The encoder sensors 363 and 403 output the pulse signals to an ASIC 651. Under the control of the MPU 601, the ASIC 651 counts the number of pulses of each of the pulse signals from the encoder sensors 363 and 403, detects the phase difference between the pulse signals, or measures the period of each pulse signal. The measurement and detection results are output to the MPU 601.

A carriage motor driver 640 drives the carriage motor 54 to reciprocally scan the carriage 50. A conveyance motor driver 642 drives the conveyance motor 35 to convey a printing medium.

In print scan of the printhead 7, the ASIC 603 transfers the drive data (DATA) of printing elements (discharge heaters) to the printhead while directly accessing a storage area of the RAM 604.

In the arrangement shown in FIGS. 1 to 4, the ink cartridges 71 and the printhead 7 are separable. They may integrate and form an exchangeable head cartridge instead. The ASIC 651 may be omitted. The ASIC 603 may process pulse signals from the encoder sensors 363 and 403 in place of the ASIC 651.

Several embodiments of printing medium conveyance control based on the outputs from a plurality of encoder sensors provided on the conveyance mechanism of a printing apparatus will be described next in detail.

[First Embodiment]

Figure 6:
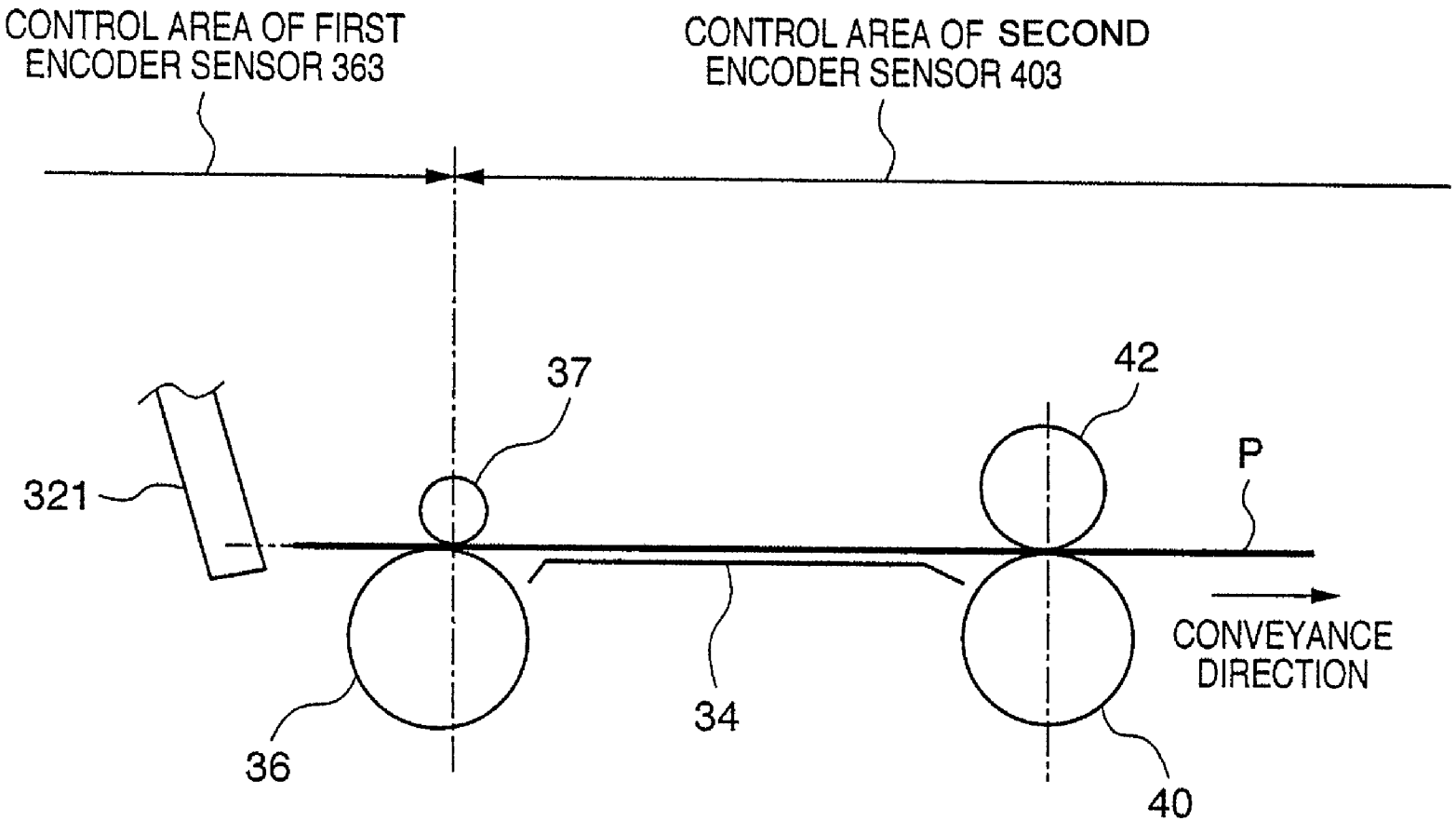
FIG. 6 is a view for explaining the control areas of a plurality of encoders.

FIG. 6 is a view for explaining the control areas of a plurality of encoders.

As shown in FIG. 6, in this embodiment, control of encoder sensors 363 and 403 is switched over according to the trailing edge position of a printing medium P. Alternatively, the encoder sensors 363 and 403 control conveyance of the printing medium P cooperatively.

In this embodiment, a PE sensor 32 detects the trailing edge position of the printing medium P. Actually, the PE sensor 32 performs detection when the leading edge of the printing medium P contacts a PE sensor lever 321 provided on a pinch roller holder that holds pinch rollers 37, or the trailing edge of the printing medium becomes to be in non-contact with the PE sensor lever 321.

As shown in FIG. 6, in this embodiment, one of the output signals from the two encoder sensors 363 and 403 is selected depending on the trailing edge position of the printing medium P. Conveyance control of the printing medium P is performed on the basis of the selected signal. As the printing medium P is conveyed, the PE sensor lever 321 and PE sensor 32 detect the trailing edge position of the printing medium P. It is possible to estimate the nip position of a conveyance roller 36 situated upstream on the basis of the detection information. Fundamentally, in an area where the conveyance roller 36 conveys the printing medium P, the conveyance operation is performed by controlling a conveyance motor 35 on the basis of information obtained from the encoder sensor 363. After the printing medium P passes through the nip of the conveyance roller 36, i.e., in an area where a discharge roller 40 situated downstream conveys the printing medium P, the conveyance operation is performed by controlling the conveyance motor 35 on the basis of information obtained from the encoder sensor 403.

This conveyance control will be described in more detail with reference to the drawings.

Figure 7A:
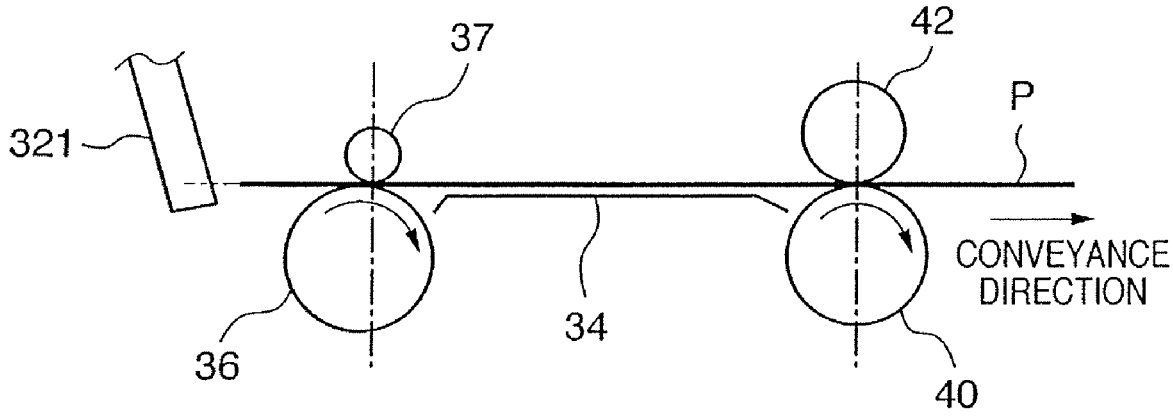
FIGS. 7A to 7C are views for explaining printing medium conveyance control according to the first embodiment.
Figure 7B:
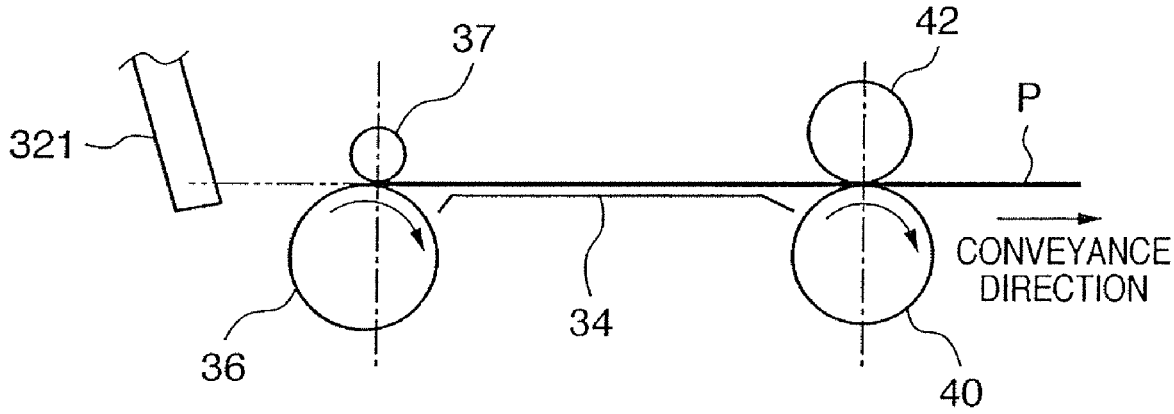
Figure 7C:
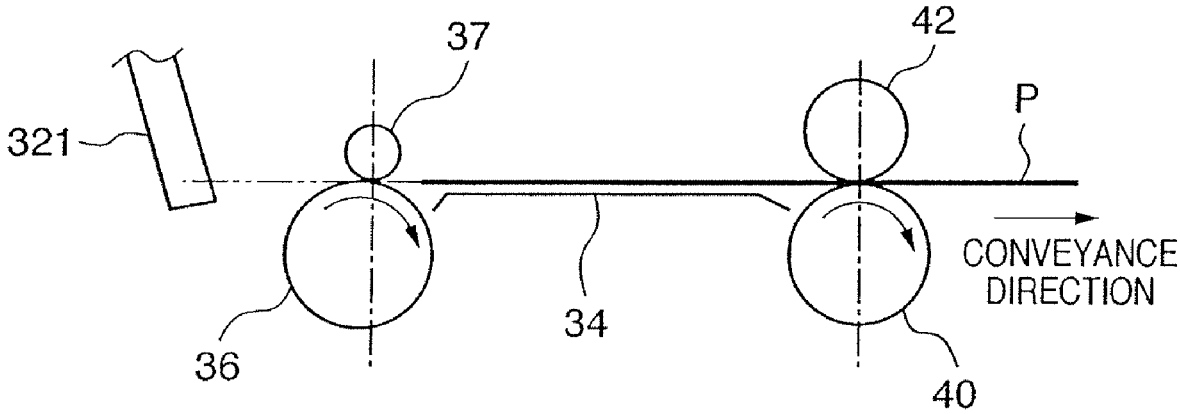

FIGS. 7A to 7C are views for explaining printing medium conveyance control.

FIG. 7A shows conveyance motor control based on information obtained from the encoder sensor 363. In this case, factors affecting the conveyance accuracy of the conveyance roller 36 are the eccentricity of the conveyance roller 36, the eccentricity of the cord wheel 362, and the eccentric phase difference between them, except the slippage of the conveyance roller 36.

FIGS. 7B and 7C show control of the conveyance motor 35 based on information obtained from the encoder sensor 403. In these cases, factors affecting the conveyance accuracy of the discharge roller 40 are the eccentricity of the discharge roller 40, the eccentricity of the cord wheel 402, and the eccentric phase difference between them, except the slippage of the discharge roller 40.

In conveyance control, it is preferable to, in the state shown in FIG. 7B, switch from control based on information obtained from the encoder sensor 363 to control based on information obtained from the encoder sensor 403. However, this control also has a drawback, as will be described later. Hence, in this embodiment, information used for conveyance control is switched from that obtained from the encoder sensor 363 to that obtained from the encoder sensor 403 in the conveyance operation immediately before the state shown in FIG. 7B occurs. From then on, the conveyance control is performed on the basis of the information obtained from the encoder sensor 403 until printing of the current page finishes.

If a conveyance operation of a non-printing area without continuous image printing is being performed in the state in FIG. 7B, switching to conveyance control based on the information from the encoder sensor 403 may be performed after the state in FIG. 7B ends.

In a conventional arrangement where the discharge roller 40 on the downstream side has no encoder sensor, the following factors affect the conveyance accuracy of the discharge roller 40 in the state shown in FIG. 7B, except the slippage of the discharge roller 40: the eccentricity of the cord wheel 402, the gear feed error (similar to eccentricity) of the pulley 361, the feed error (similar to eccentricity) of the idler gear 45, the feed error (similar to eccentricity) of the roller gear 404, the eccentricity of the discharge roller 40, and the eccentric phase difference between them. Hence, the arrangement according to this embodiment can improve the eccentric errors of three gears. In actuality, the arrangement has succeeded in reducing conveyance errors to about ½ in simulations and experiments.

Intermittent conveyance control of a printing medium by easily servo-controlling a DC motor (conveyance motor) on the basis of information obtained from encoder sensors will be described next.

In servo control, the printing medium conveyance speed is increased/decreased up to a stop target position designated in advance. Near the stop target position, control is made to maintain a very low constant speed just before stop. At the instant when the printing medium has reached the stop target position, driving power supply to the DC motor is shut down. Then, the printing medium stops when the inertia and frictional resistance of the mechanism balance with each other.

An example to be described below concerns an area where printing medium conveyance is controlled to a very low speed just before stop in the conveyance operation upon switching over information obtained from the above-described two encoder sensors for conveyance control.

Switching of pulse signals from the encoder sensors will be explained first.

In this embodiment, an MPU 601 and an ASIC 651 cooperatively switch the pulse signals from the encoder sensors to be used for conveyance control.

Figure 8:
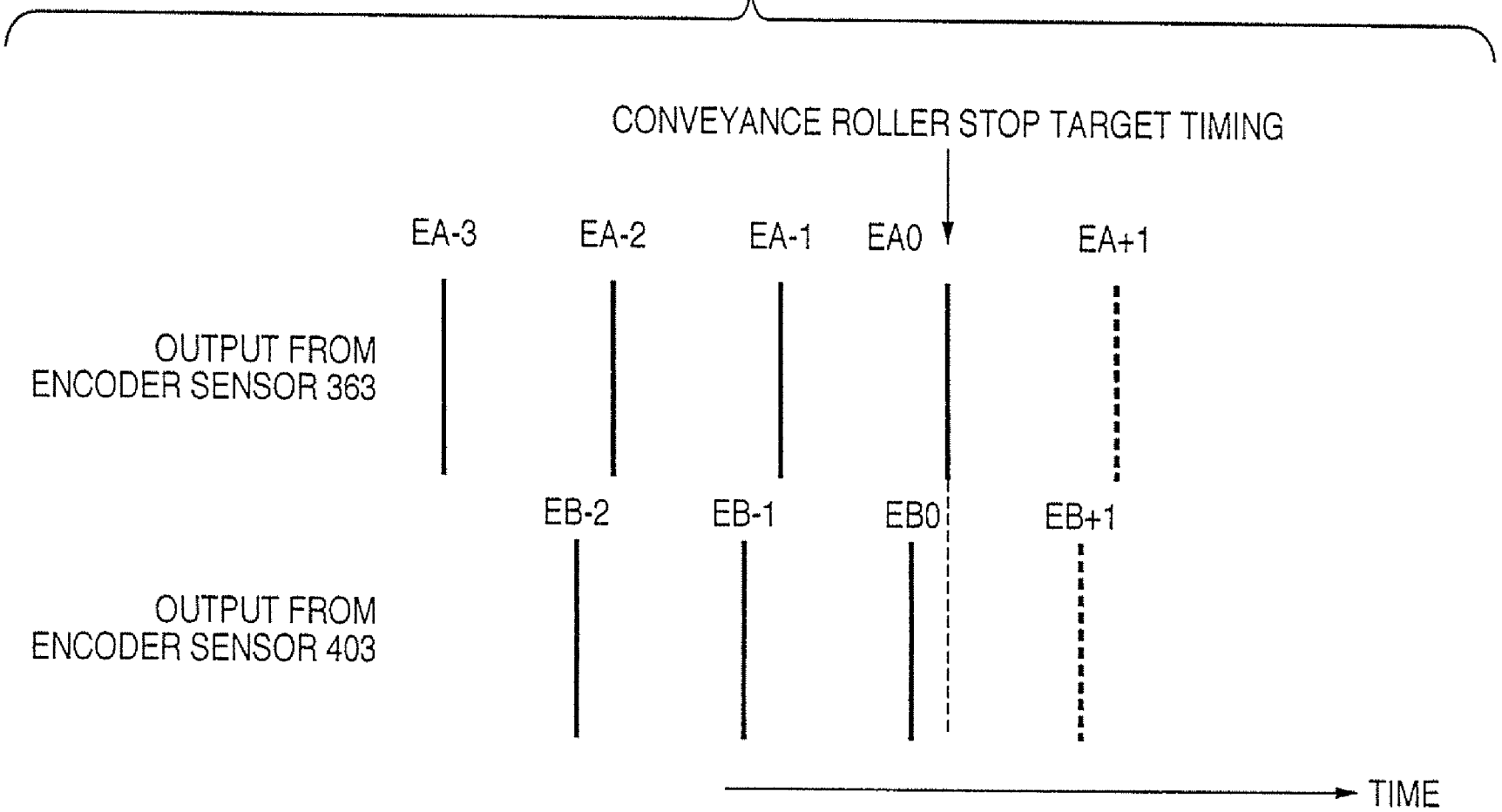
FIG. 8 is a timing chart showing a sequence in pulse signals from encoder sensors 363 and 403 according to the first embodiment.

FIG. 8 is a timing chart showing a sequence of pulse signals from the encoder sensors 363 and 403. In FIG. 8, a symbol EA0 denotes a stop target timing in a final conveyance operation (intermittent conveyance) based on an output from the encoder sensor 363. After this timing, the conveyance operation (intermittent conveyance) is performed, based on an output form the encoder sensor 403.

As shown in FIG. 8, a pulse signal EA0 is defined as the stop target position of the conveyance roller. The ASIC 651 detects pulse signals EA−3, EA−2, EA−1, and EA0. The ASIC 651 also detects pulse signals EB−2, EB−1, and EB0 from the encoder sensor 403. Pulse signals EA+1 and EB+1 are expressed as pulse signals to be detected in the future for the sake of convenience.

As described above, the ASIC 651 includes two counters: a counter that counts pulse signals from the encoder sensor 363 and a counter that counts pulse signals from the encoder sensor 403. When pulse signal detection has reached the stop target position of the conveyance roller, the count value of the counter that counts pulse signals from the encoder sensor 363 is overwritten on the count value of the counter that counts pulse signals from the encoder sensor 403. At the same time, the ASIC 651 switches to receive the pulse signals from the encoder sensor 403 under the control of the MPU 601. From then on, conveyance control is performed on the basis of the pulse signals from the encoder sensor 403.

In this control, the pulse signal EA0 from the encoder sensor 363 is recognized to be equal to the pulse signal EB0 from the encoder sensor 403. Then, conveyance control is performed on the basis of the count value of pulse signals from the encoder sensor 403.

In this embodiment, the count value up to the pulse signal EA0 is overwritten on the count value of the pulse signal EB0. However, the count value of pulse signals from the encoder sensor 403 may be defined as a reference for the printing medium stop target position after switching of the pulse signal source, without changing the count value of the pulse signal EB0.

If necessary, it is possible to change the control parameters at the moment when the object of control has changed. Such change is effective when, for example, the resolution of the encoder sensor 363 on the printing medium P is different from that of the encoder sensor 403 on the printing medium P. More specifically, since the information amount per unit time is different, changing the gain or the issuing rate of a command for the low-speed control area of the conveyance roller just before stop makes it possible to obtain a stable pre-stop speed or optimize (shorten) the stop time.

Take-over from the pulse signals from the encoder sensor 363 to those from the encoder sensor 403 is preferably performed at the instant when the printing medium P passes through the nip of the conveyance roller 36 because this minimizes the eccentric error of the downstream chain of drives. In fact, when the printing medium passes through the nip, the pair of conveyance rollers 36 and 37 generate a mechanical force to move the printing medium P ahead due to the spring force of the pinch rollers 37. To eliminate this external disturbance, the take-over is preferably performed before the printing medium P passes through the nip of the conveyance roller. Take-over that occurs during fast conveyance greatly suffers external disturbances caused by the mechanical elasticity of a chain of drives, moment of inertia, counter time resolution, and control traceability. Hence, the take-over is preferably performed when the printing medium is conveyed at a low speed or is at a standstill. In particular, to eliminate the effect of backlash at the stop or uncertain operations from the start of stop operation to the actual stop, it is more preferable to perform take-over at the start of stop operation or immediately before the stop operation, depending on the situation.

According to the above-described embodiment, it is possible to greatly improve the conveyance accuracy after a printing medium passes through the conveyance rollers. This enables printing at a higher image quality. Additionally, high-speed printing can be implemented by relaxing the conventionally required restriction on the use nozzles of the printhead and increasing the conveyance amount.

[Second Embodiment]

In the first embodiment, an example of pulse signals output from two encoder sensors has been described. In the second embodiment, conveyance control considering the phase difference between two pulse signals will be explained.

If two encoder sensors have the same position detection resolution for printing medium conveyance, and for example, if both encoder sensors have a resolution corresponding to a quadruple (two phases and two edges) of 1,800 dpi, a pulse signal is detected at a pitch of 7,200 dpi=about 3.5 μm interval. This indicates that take-over from pulse signals from an encoder sensor 363 to those from an encoder sensor 403 can generate a shift of 3.5 μm at maximum depending on the phase difference of pulse signals.

In this embodiment, to reduce the shift by half, an ASIC 651 detects the phase difference between two pulse signals. A pulse signal closer to the pulse signal count value take-over timing is determined and selected.

Figure 9:
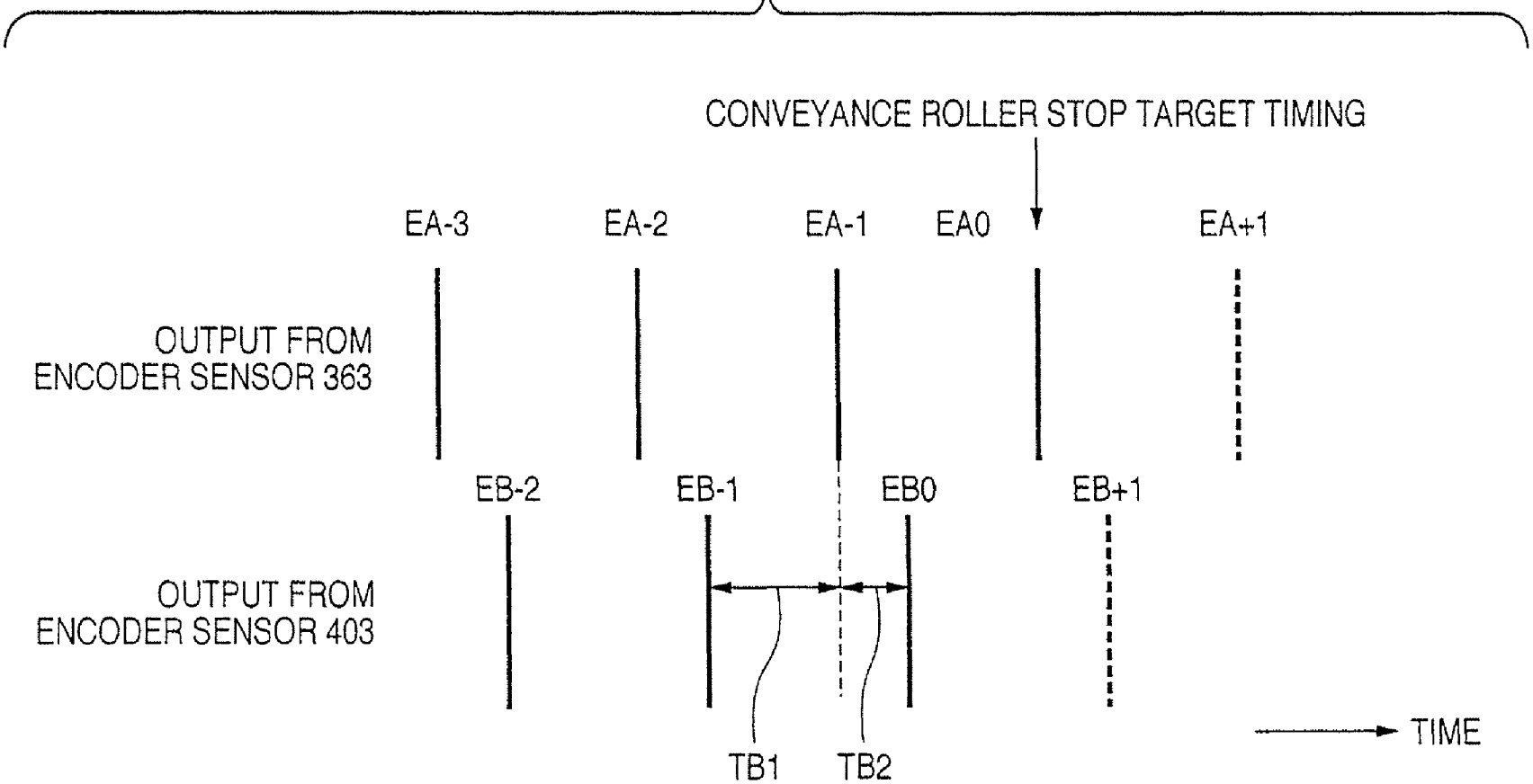
FIG. 9 is a timing chart showing a sequence in pulse signals from encoder sensors 363 and 403 according to the second embodiment.

FIG. 9 is a timing chart showing sequences in pulse signals from the encoder sensors 363 and 403. Similar to FIG. 8, in FIG. 9, a symbol EA0 denotes a stop target timing in a final conveyance operation (intermittent conveyance) based on an output from the encoder sensor 363.

As shown in FIG. 9, a pulse signal EA0 is defined as the stop timing of a conveyance roller 36. The ASIC 651 detects pulse signals EA−3, EA−2, EA−1, and EA0 from the encoder sensor 363. The ASIC 651 also detects pulse signals EB−2, EB−1, and EB0 from the encoder sensor 403. In FIG. 9, pulse signals EA+1 and EB+1 are expressed as pulse signals to be detected in the future for the sake of convenience.

A time difference TB1 between the pulse signals EB−1 and EA−1 and a time difference TB2 between the pulse signals EA−1 and EB0 are measured. Which of the pulse signals EB−1 and EB0 is closer to the pulse signal EA−1 is determined on the basis of the two values.

In this example, TB1>TB2. Hence, the pulse signal EA−1 is determined to be closer to the pulse signal EB0, and a process for setting EA−1=EB0 is performed. That is, the measurement value up to the pulse signal EA−1 is overwritten on the measurement value of the pulse signal EB0. If TB1<TB2, a process for setting EA−1=EB−1 is performed.

This makes it possible to reduce the error generated by the phase difference between the pulse signals from the two encoder sensors upon taking over the measurement value of pulse signals, to ½ or less of the resolution of the encoder sensor 403. As described above, when the two encoder sensors have the same resolution, the error caused by the phase difference decreases to 7200 dpi pitch×½=about 1.8 μm. Hence, more accurate conveyance can be implemented.

In this embodiment, to determine which pulse is closer to the pulse signal EA−1, only the time difference between pulse signals is taken as a criterion. In a case where printing medium conveyance is to be stopped by servo control, it assumes that control is made to maintain a very low constant speed just before stop. However, in a case where control including acceleration is made intentionally, pulse signals are compared taking the acceleration into consideration. More specifically, when speed information (and estimated value) is taken into consideration, the phase difference between pulse signals from the two encoder sensors can be obtained by using the distance (time×speed) as an index of comparison.

To minimize the eccentric errors of rollers as much as possible, preferably, the take-over position of the measurement value of pulse signals from an encoder sensor is set closer to the stop target position of the conveyance roller to determine a nearer pulse signal at or just before the stop target position of the conveyance roller.

Figure 10:
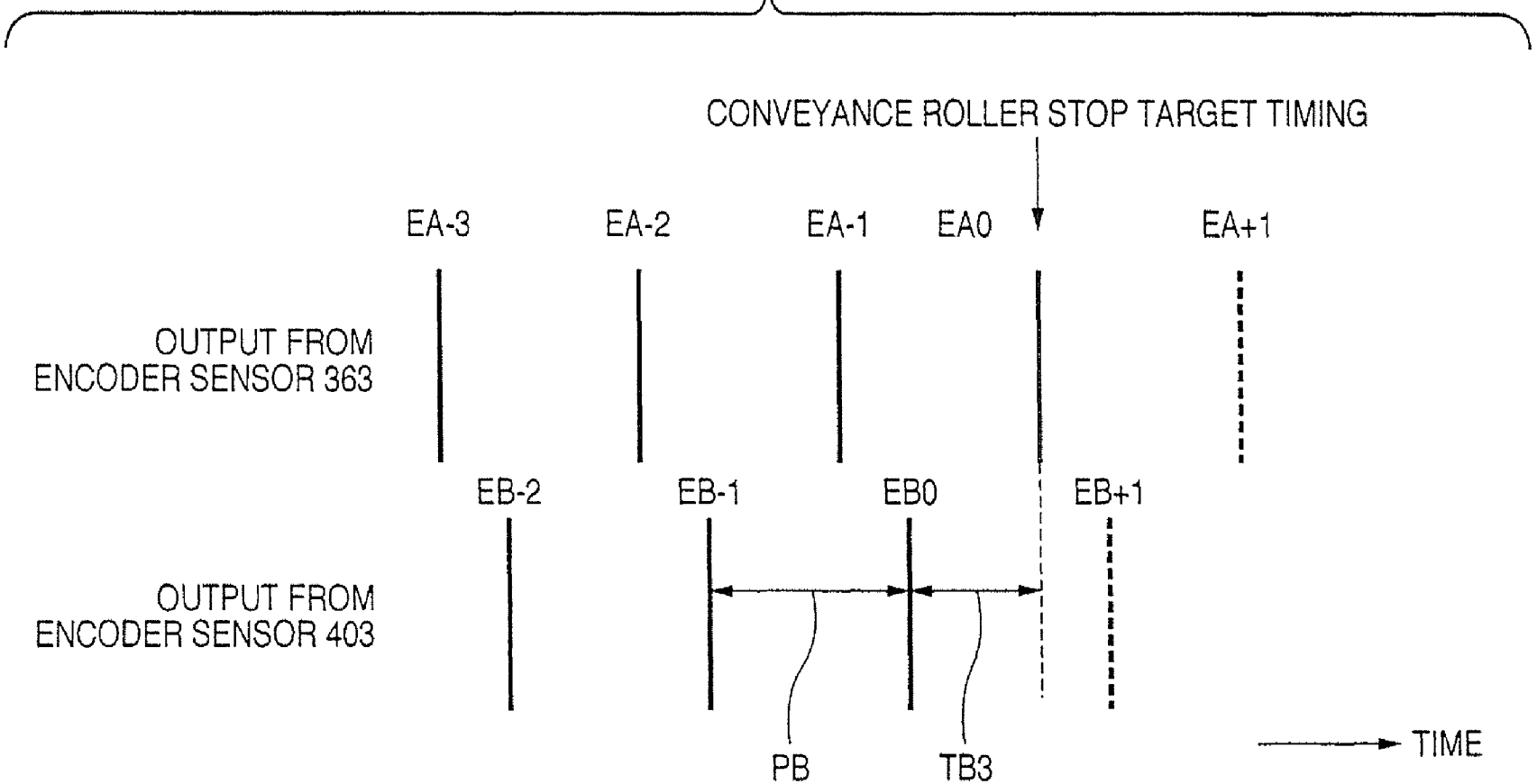
FIG. 10 is another timing chart showing a sequence in pulse signals from the encoder sensors 363 and 403 according to the second embodiment.

FIG. 10 is another timing chart showing a sequence in pulse signals from the encoder sensors 363 and 403.

As shown in FIG. 10, in this example, a time difference PB between the pulse signals EB−1 and EB0 and a time difference TB3 between the pulse signals EB0 and EA0 are measured. TB3 is compared with PB−TB3. PB−TB3 is regarded as the time difference between the pulse signal EA0 and the pulse signal EB+1 to be detected in the future. On the basis of the comparison result, a nearer pulse signal is determined at or just before the stop target position of the conveyance roller, as described above.

Figure 11:
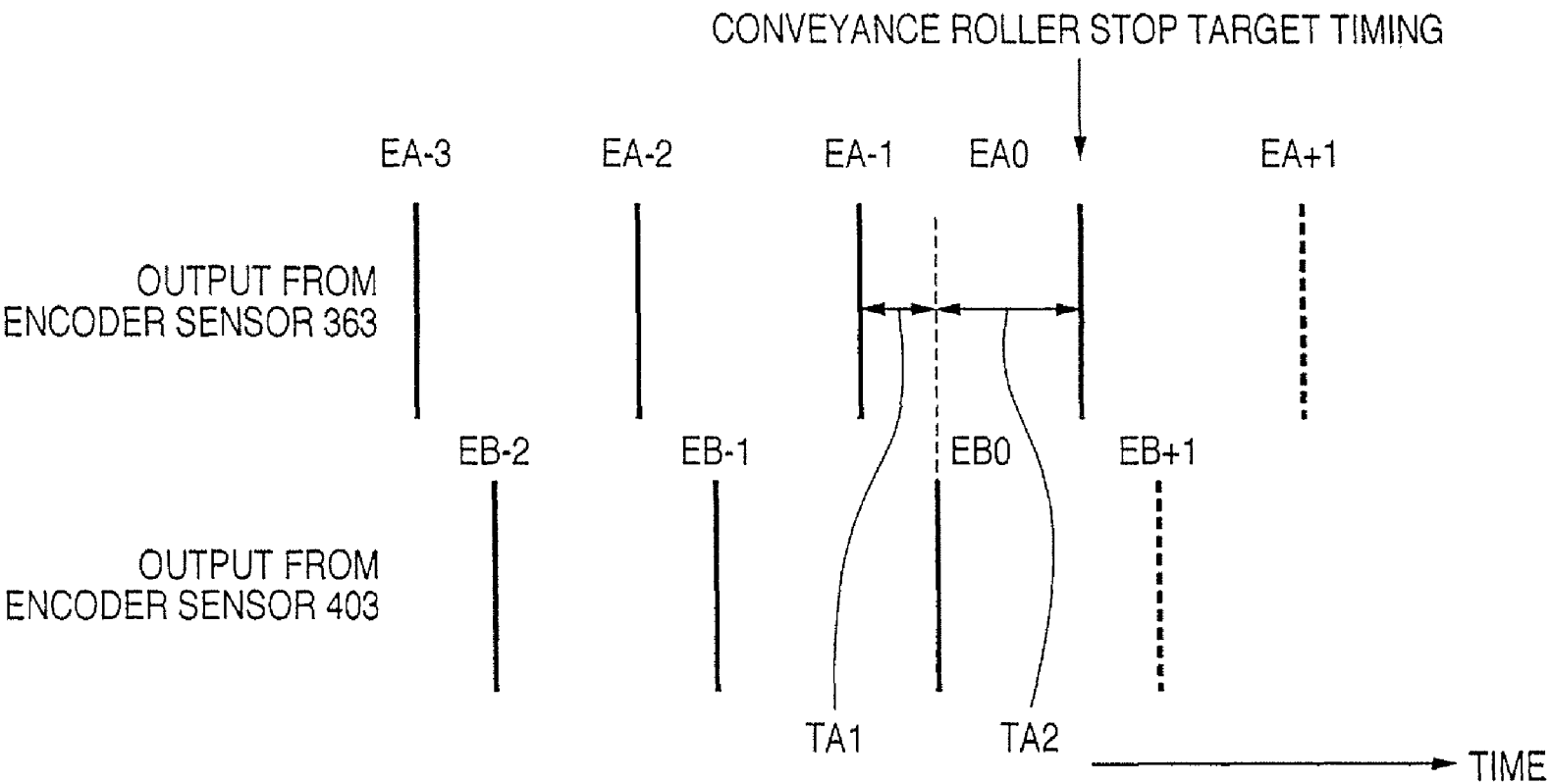
FIG. 11 is still another timing chart showing a sequence in pulse signals from the encoder sensors 363 and 403 according to the second embodiment.

FIG. 11 is still another timing chart showing a sequence in pulse signals from the encoder sensors 363 and 403.

As shown in FIG. 11, the base point of time count may be changed for determination of a nearer pulse signal. More specifically, based on the pulse signal EA−1, a time difference TA1 between the pulse signals EA−1 and EB0 and a time difference TA2 between the pulse signal EB0 and the pulse signal EA0 following the pulse signal EA−1 are measured. The count values of the nearer pulse signals EA−1 and EB0 may be adjusted, based on the time differences TA1 and TB1. In this case, a pulse signal from the encoder sensor 363 nearer to a pulse signal from the encoder sensor 403 is determined and selected. This makes it possible to reduce the error generated by the phase difference to ½ or less of the resolution of the encoder sensor 363.

The timing of obtaining the phase difference and the timing of taking over the measurement value of pulse signals need not always be coincidental. However, to achieve accurate conveyance, these timings is preferably coincidental.

Control according to this embodiment does not affect servo control or printing medium stop control itself so much and is comparatively easy to implement.

Control according to this embodiment need not always employ the above-described phase difference detection method and nearer pulse selection method. Any other method may be usable as far as the phase difference between pulse signals from two encoder sensors can be detected, and a nearer pulse signal can be selected.

[Third Embodiment]

In the third embodiment, a method of more accurately taking over the measurement value of pulse signals from an encoder sensor and more accurately stop printing medium conveyance as compared to the second embodiment will be described.

Figure 12:
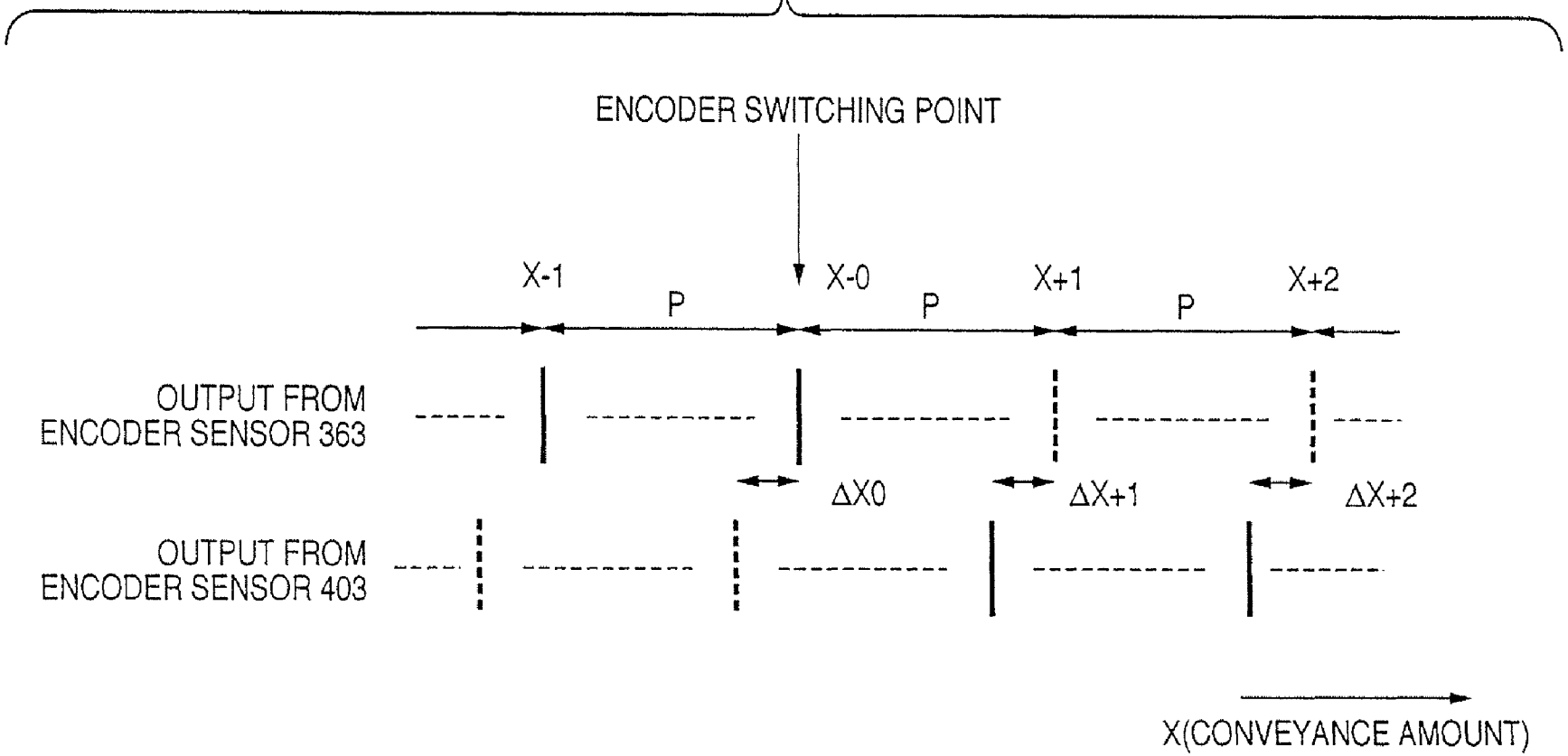
FIG. 12 is a view showing the relationship between a printing medium conveyance amount and pulse signals from encoder sensors 363 and 403 according to the third embodiment.

FIG. 12 is a view showing the relationship between a printing medium conveyance amount and pulse signals from encoder sensors 363 and 403. In FIG. 12, the abscissa represents a conveyance amount (X) of a printing medium P, and the broken horizontal lines schematically represent enormous pulse signal outputs from the encoder sensors. In the example shown in FIG. 12, the encoder sensors 363 and 403 have the same printing medium conveyance position detection resolution, and conveyance is performed at a uniform conveyance amount P.

Referring to FIG. 12, before the encoder switching point (left side of FIG. 12), the stop target positions are set to be at positions X−1 and X0 by the uniform feed amount P on the basis of pulse signals from the encoder sensor 363. Printing medium conveyance stops at the stop target position.

Assume that pulse signals from the two encoder sensors shift at the switching point by ΔX in conveyance amount. When after the switching point (right side of FIG. 12), the printing medium stop target positions are determined on the basis of pulse signals from the encoder sensor 403, shifts from the target positions are generated, as shown in FIG. 12. That is, shifts ΔX+1 and ΔX+2 are generated from positions X+1 and X+2, respectively. In this case, ΔX=ΔX+1=ΔX+2 nearly holds.

To eliminate this shift, in the third embodiment, the phase difference (TB) between a pulse signal from the encoder sensor 403 and a pulse signal from the encoder sensor 363 is measured, as in the second embodiment. From the switching point shown in FIG. 12, this information is reflected on the stop target position of the conveyance roller controlled on the basis of pulse signals from the encoder sensor 403.

More specifically, as described in the second embodiment, the phase difference between pulse signals from the two encoder sensors is detected. For example, as shown in FIG. 9, it is possible to grasp, on the basis of phase differences TB1 and TB2, the position where a pulse signal EA−1 from the encoder sensor 363 is located between pulse signals EB−1 and EB0 from the encoder sensor 403. For example, the measurement unit of pulse signals from the encoder sensor 403 is finely set to virtually measure pulse signals even in places (or at times) without pulse signals. A pulse signal measurement value can be set as a condition that the pulse signal EA−1 is located at a position corresponding to TB1: TB2 with respect to the pulse signals EB−1 and EB0.

Figure 13:
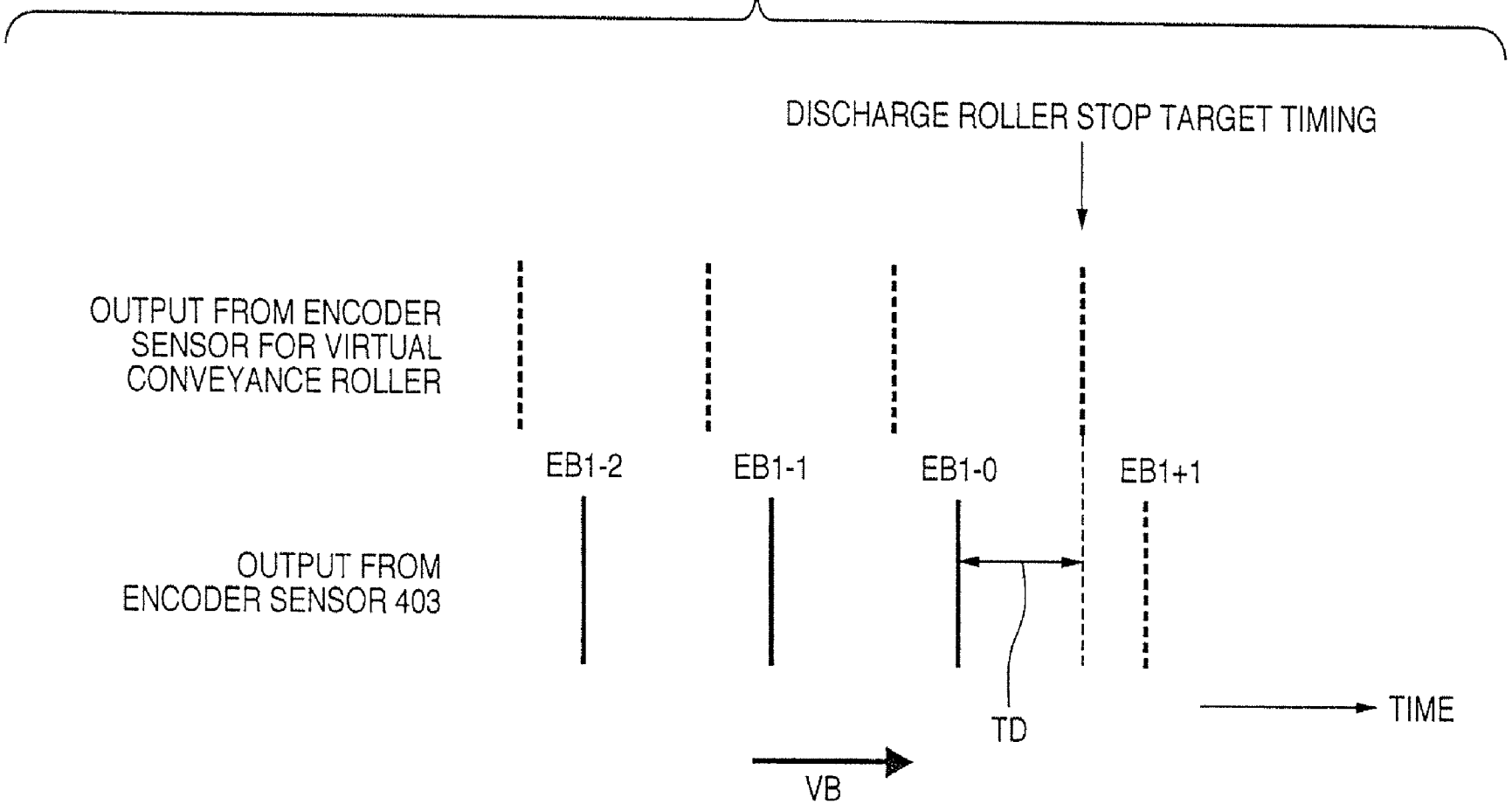
FIG. 13 is a timing chart showing a sequence in pulse signals from an encoder sensor for a virtual conveyance roller and those from an encoder sensor 403.

In other words, as shown in FIG. 13, a pulse signal from an encoder sensor for a virtual conveyance roller can be identified between two pulse signals from the encoder sensor 403. This measurement value does not indicate a pulse signal from the encoder sensor 403 itself but is usable as a virtual measurement value to estimate the position of the printing medium P.

Likewise, it is easy to reflect the phase difference detection result shown in FIGS. 10 and 11 of the second embodiment, as a matter of course.

FIG. 13 is a timing chart showing a sequence in pulse signals from an encoder sensor for a virtual conveyance roller and those from the encoder sensor 403.

When the stop target position (timing) of the discharge roller is determined by using these measurement values, as shown in FIG. 13, the delay distances ΔX+1 and ΔX+2 from pulse signals from the encoder sensor 403 can be determined. Concerning stop at the position X+1, as shown in FIG. 13, a time delay TD based on a pulse signal EB1−0 just before the stop target position of the discharge roller is obtained from the delay distance ΔX+1 and speed information VB just before conveyance stop based on a pulse signal from the encoder sensor 403. On the basis of the time delay, the stop operation is performed after the elapse of the time TD from the pulse signal EB1−0.

This allows to stop conveying the printing medium at the stop target position X+1 where the ideal feed pitch P is ensured in a place without a pulse signal. Similarly, even concerning the position X+2, the stop operation is performed after the elapse of the time delay TD VB/(ΔX+2).

If the encoder sensors 363 and 403 have the same position detection resolution, almost the same accuracy is obtained by using the value of the phase difference between two pulse signals as the delay value of conveyance stop using a pulse signal from the encoder sensor 403 after the switching point.

Japanese Patent Laid-Open No. 2005-132028 has already disclosed a technique of stopping conveyance at a target position where a pulse signal does not exist by adding a time delay to a pulse signal from an encoder sensor. Hence, a characteristic feature of this embodiment is that the phase error between pulse signals from the two encoder sensors is detected on the basis of a pulse signal from the encoder sensor 403, which is to be used for subsequent conveyance control, and reflected on conveyance control, thereby correcting the phase error.

According to this embodiment, the phase difference between pulse signals from two encoder sensors is detected upon taking over the measurement value of pulse signals. The phase difference can be reflected on a subsequent printing medium conveyance stop target position (and timing) by the discharge roller. This implements ideal conveyance stop.

[Fourth Embodiment]

In the first to third embodiments, the encoder sensors 363 and 403 have the same printing medium conveyance position detection resolution for the descriptive convenience. However, the present invention is not limited to this. For example, an encoder sensor 403 may have a resolution lower than that of an encoder sensor 363 by reducing the diameter of a discharge cord wheel 402 because of limitations on the housing size of the printing apparatus. Conversely, if, e.g., the eccentricity of a discharge roller 40 cannot have a sufficient relative accuracy, the resolution of the encoder sensor 403 may be made higher than that of the encoder sensor 363 to improve the control stability by increasing the diameter of the discharge cord wheel 402 and suppressing the eccentricity.

Figure 14:
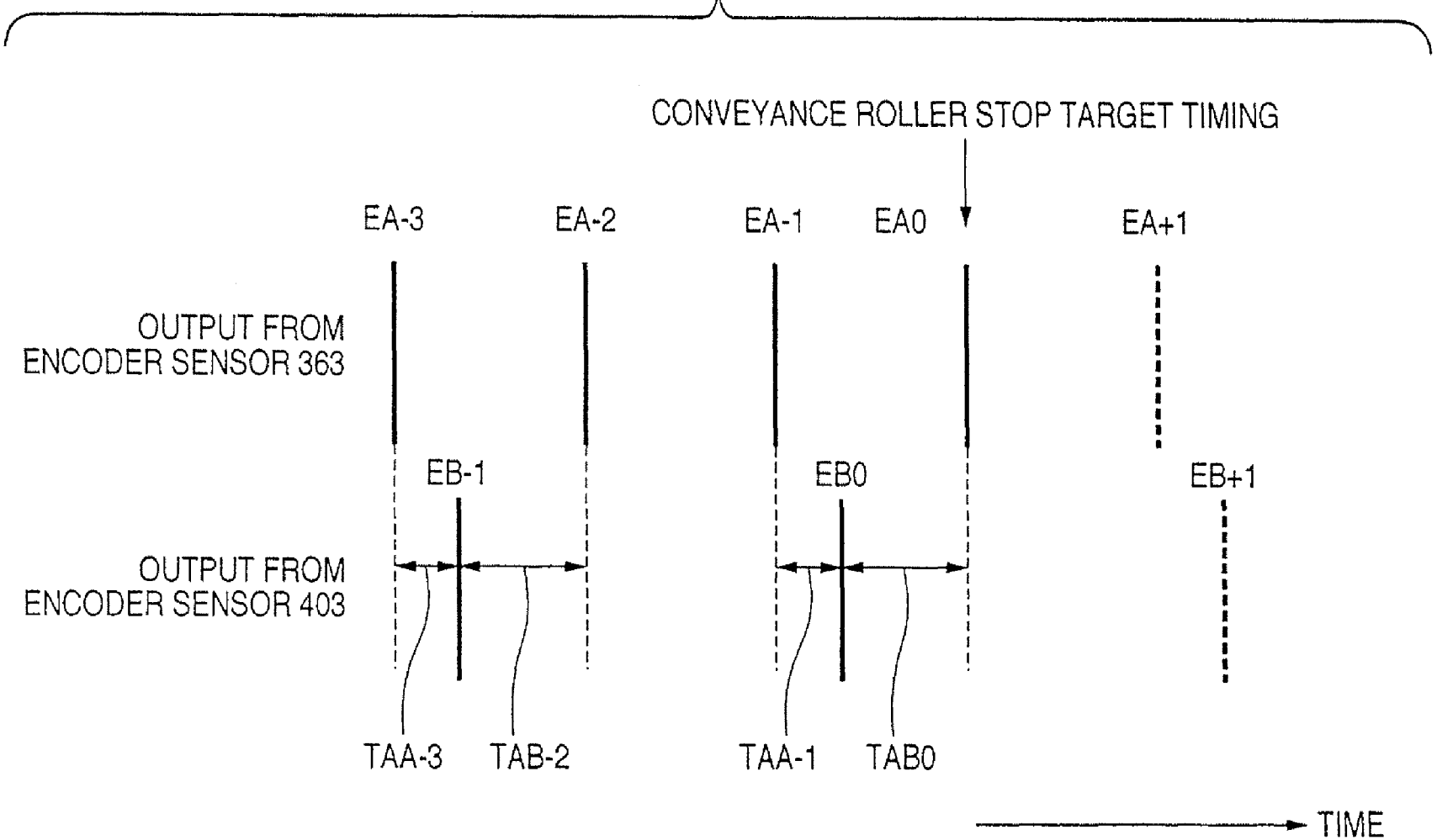
FIGS. 14 and 15 are timing charts showing sequences in pulse signals from an encoder sensor 363 with a high position detection resolution and those from an encoder sensor 403 with a low position detection resolution according to the fourth embodiment.
Figure 15:
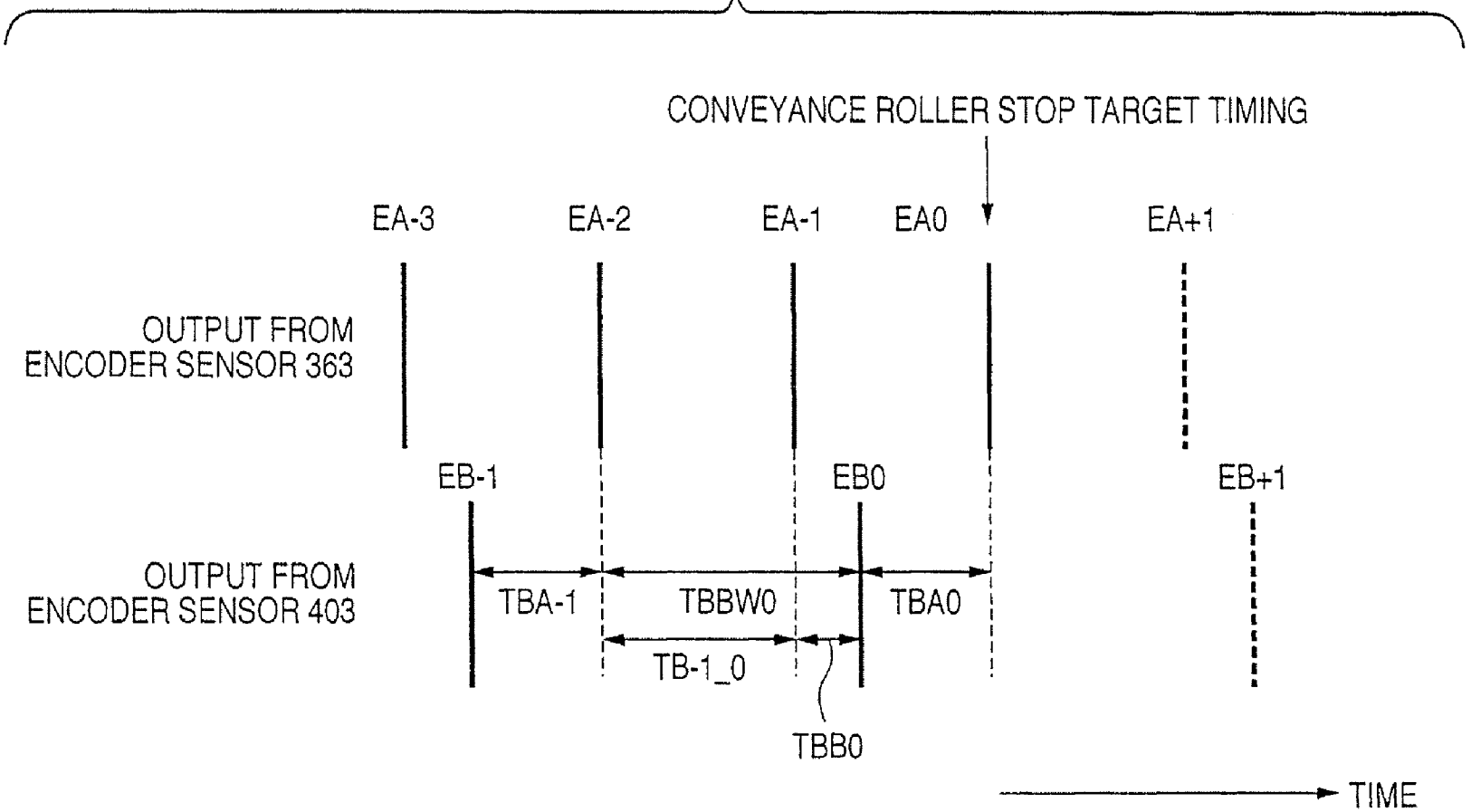

FIGS. 14 and 15 are timing charts showing a sequence in pulse signals from the encoder sensor 363 with a high position detection resolution and those from the encoder sensor 403 with a low position detection resolution.

Figure 16:
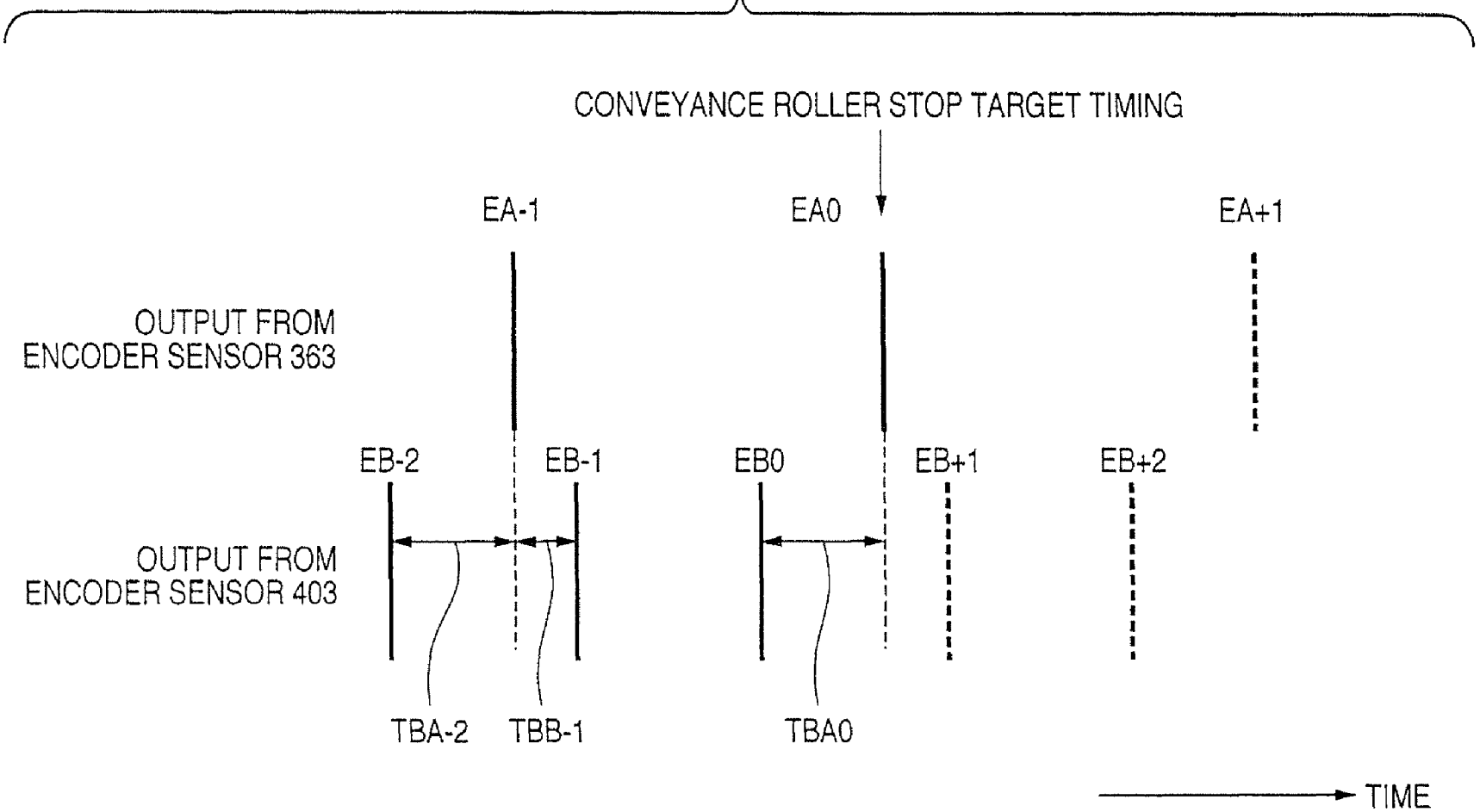
FIG. 16 is a timing chart showing a sequence in pulse signals from an encoder sensor 363 with a low position detection resolution and those from an encoder sensor 403 with a high position detection resolution according to the fourth embodiment.

FIG. 16 is a timing chart showing a sequence in pulse signals from the encoder sensor 363 with a low position detection resolution and those from the encoder sensor 403 with a high position detection resolution.

In FIGS. 14 to 16, the position detection resolutions of the two encoder sensors are different from each other by two times.

An example shown in FIG. 14 will be described.

In this example, the time from a pulse signal from the encoder sensor 363 to the next pulse signal from the encoder sensor 403 is measured. Additionally, the time from that pulse signal to the next pulse signal from the encoder sensor 363 is measured. If two consecutive pulse signals (e.g., pulse signals EA−2 and EA−1) from the encoder sensor 363 are detected, time measurement is canceled during that time.

In this way, in the example shown in FIG. 14, the time (TAA−3) between pulse signals EA−3 and EB−1, the time (TAB−2) between the pulse signals EB−1 and EA−2, the time (TAA−1) between the pulse signals EA−1 and EB0, and the time (TAB0) between the pulse signals EB0 and EA0 can be detected. These times are applicable to the above-described second and third embodiments.

An example shown in FIG. 15 will be described.

In this example, a pulse signal from the encoder sensor 403 is used as a base point.

First, the time from a pulse signal from the encoder sensor 403 to the next pulse signal from the encoder sensor 403 is measured. Additionally, the time from that pulse signal to the next pulse signal is measured. If the second detected pulse signal is of the encoder sensor 403, the measurement process finishes. However, if the second detected pulse signal is of the encoder sensor 363 (e.g., EA−1 next to EA−2), the time from this pulse signal to the next pulse signal is measured (e.g., EB0 next to EA−1).

In this way, the time (TBA−1) between the pulse signals EB−1 and EA−2, the time (TB−1_0) between the pulse signals EA−2 and EA−1, and the time (TBB0) between the pulse signals EA−1 and EB0 can be detected. The time between the pulse signals EB0 and EA0 can also be detected.

A measuring method different from time measurement described above is also usable.

The time from a pulse signal from the encoder sensor 403 to a pulse signal from the encoder sensor 363 is measured. Additionally, the time from that pulse signal to the next pulse signal from the encoder sensor 403 is measured (e.g., from EA−2 to EB0). According to this method, it is unnecessary to store the measurement value upon detecting the pulse signal EA−1, unlike the above-described method.

As still another method, for example, a counter that counts the time to the pulse signals EA−2, EA−1, and EB0 in FIG. 15 may be prepared.

An example shown in FIG. 16 will be described finally.

In this example, an operation reverse to the example shown in FIG. 14 is performed. More specifically, on the basis of a pulse signal from the encoder sensor 403, the time (TBA−2) between the pulse signals EB−2 and EA−1, the time (TBB−1) between the pulse signals EA−1 and EB−1, and the time (TBA0) between the pulse signals EB0 and EA0 can be detected.

Likewise, even in time measurement based on a pulse signal from the encoder sensor 363, a desired time can be detected by performing an operation reverse to the example shown in FIG. 15.

The method of measuring the time between pulse signals is not limited to those described above. Any other method is usable if it can detect the phase difference between encoders with different resolutions.

According to the above-described embodiment, even if the two encoder sensors have different position detection resolutions, time between pulse signals can be measured. Thus, it is possible to perform accurate conveyance control by applying the obtained times to the second or third embodiment. Hence, even if the encoder sensors have different resolutions to improve the space efficiency for reasons of the housing size and structure of the printing apparatus, accurate conveyance control can be implemented while flexibly coping with the situations.

[Fifth Embodiment]

An example of obtaining a phase shift amount more accurately will be described.

In the above-described embodiments, the phase shift amount detection timing is set at or just before the stop of conveyance operation. To further increase the phase shift amount detection accuracy, the phase shift amount near the conveyance stop is detected a plurality of number of times, and the average of the detected amounts is used as the phase shift amount.

Figure 17:
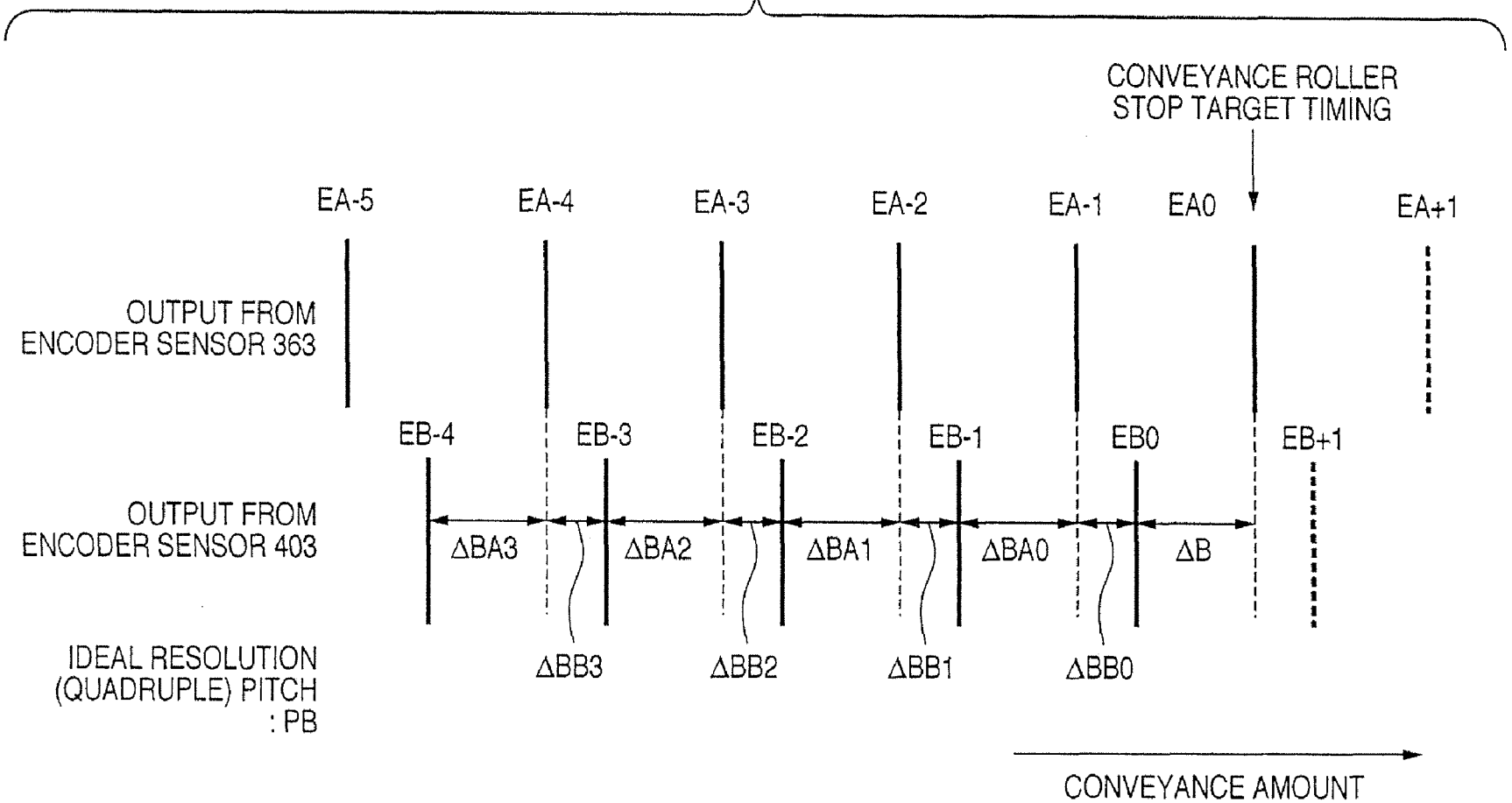
FIG. 17 is a view for explaining a process of detecting a phase shift amount a plurality of number of times and averaging the detected amounts according to the fifth embodiment.

FIG. 17 is a view for explaining a process of detecting a phase shift amount a plurality of number of times and averaging the detected amounts.

As shown in FIG. 17, let ΔBA0, ΔBA1, . . . , ΔBB0, ΔBB1, . . . be the shift amounts (distances) between pulse signals from an encoder sensor 363 on the upstream side and those from an encoder sensor 403 on the downstream side in the conveyance direction. In this example, the shift amount is defined as a distance. The shift amount may be a time corresponding to the distance.

Let PB be the ideal pitch corresponding to a quadruple of a pulse signal from the downstream encoder sensor 403. A phase shift amount (ΔB) between a pulse signal from the encoder sensor 363 and a pulse signal from the encoder sensor 403 is given by $$\Delta B = PB \times \Sigma(\Delta BAx)/\Sigma(\Delta BAx + \Delta BBx),\ (x=0 \text{ to } N)$$

The shift amount is obtained as a distance here. However, it may be obtained as a time.

As described above, since phase shift amounts obtained from a plurality of pulse signals are averaged, a variation on mechanical behavior or a variation in speed control can be reduced. Since at least four adjacent phase shift amounts are averaged, the characteristic variation of encoder sensors can also be reduced. An encoder sensor normally outputs a total of four signals during a single period: leading edge in A phase; leading edge in B phase; trailing edge in A phase; and trailing edge in B phase. Hence, it is meaningful to average four adjacent phase shift amounts.

A thus obtained average phase shift amount is applicable to the third embodiment. Alternatively, comparison of the values Σ(ΔBAx) and Σ(ΔBBx) is applicable to determination in the second embodiment. This contributes to stable conveyance accuracy.

If the encoder sensors 363 and 403 have the same position detection resolution, simple averaging of phase shift amounts suffices, as described above. If they have different resolutions, phase shift amounts obtained from pulse signals should be normalized and averaged. Upon taking over the measurement value of pulse signals from the encoder sensor 363 to that of pulse signals from the encoder sensor 403, the averaged phase shift amount is converted into a resolution to be used.

Let RP1 be the quadruple pitch of the resolution of the encoder sensor 363, and RP2 be the quadruple pitch of the resolution of the encoder sensor 403. Every time a detected pulse signal shifts by one pulse, a shift amount (RP1−RP2) is added (or subtracted) regardless of the phase shift. This amount is handled as a normalized phase shift amount. If the resolutions of the two encoder sensors are different by about two times or more, it is necessary to consider whether or not a pulse signal of the counterpart for phase shift detection does not outpace the adjacent pulse signal.

The averaging method mentioned in this embodiment is not limited to that described above. The information of a pulse signal at the stop target position of the conveyance roller may be contained to add information just before conveyance stop. Alternatively, to cancel the characteristic of the phase of an encoder sensor, only the information of an in-phase pulse signal may be used. That is, any method of obtaining a representative phase difference from a plurality of phase difference information is not departed from the scope of the invention.

When a representative phase difference is derived from many phase difference information, a more accurate phase difference can be obtained by smoothing the characteristics of encoder sensors, the behavior of the mechanical portion, and the unstable factors of control. When this is applied to the second and third embodiments, more accurate conveyance control can be implemented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227017, filed Aug. 23, 2006, which is hereby incorporated by reference herein in its entirety.

What is claimed is:

1. A printing apparatus for printing on a printing medium using a printhead comprising:

a first conveyance roller for conveying the printing medium;

a second conveyance roller, provided at a downstream side from said first conveyance roller with respect to a conveyance direction of the printing medium, for conveying the printing medium;

a first encoder configured to output a first signal in accordance with a rotation of said first conveyance roller for obtaining conveyance information based on the first signal;

a second encoder configured to output a second signal in accordance with a rotation of said second conveyance roller for obtaining conveyance information based on the second signal; and a control unit, having a first counter for counting pulses included in the first signal and a second counter for counting pulses included in the second signal, configured to control conveyance of the printing medium on the basis of the count value of the first counter or the count value of the second counter, wherein in a case where the printing medium is conveyed in a direction from said first conveyance roller to said second conveyance roller, said control unit switches from the count value of the first counter to the count value of the second counter for conveyance control, based on a position of a trailing edge of the printing medium, and said control unit takes over the count value of the first counter, based on a phase difference between the first signal and the second signal, for subsequent conveyance control for which the count value of the second counter is used.

2. The apparatus according to claim 1, wherein said first conveyance roller and said second conveyance roller are driven by a single motor.

3. The apparatus according to claim 1, wherein a detection resolution of said first encoder equals that of said second encoder.

4. The apparatus according to claim 1, wherein detection resolution of said first encoder is different from that of said second encoder.

5. The apparatus according to claim 1, wherein said control unit detects the phase difference a plurality of number of times, and an average of the detected amounts is to be used.

6. The apparatus according to claim 1, further comprising a sensor for sensing the trailing edge of the printing medium, said sensor being provided at a upstream side from said first conveyance roller with respect to the conveyance direction of the printing medium, wherein said control unit performs the switching based on sensing by said sensor.

7. A conveyance control method of a printing apparatus for printing on a printing medium using a printhead, the method comprising:

a first step of counting pulses included in a first signal outputted from a first encoder by a first counter, in accordance with a rotation of a first conveyance roller provided in a conveyance path of the printing medium;

a second step of counting pulses included in a second signal outputted from a second encoder by a second counter, in accordance with a rotation of a second conveyance roller provided in the conveyance path at a downstream side from the first conveyance roller with respect to the conveyance direction of the printing medium; and a control step of controlling conveyance of the printing medium on the basis of the count value of the first counter or the count value of the second counter, in a case where the printing medium is conveyed in a direction from the first conveyance roller to the second conveyance roller, switching from the count value of the first counter to the count value of the second counter for conveyance control, based on a position of a trailing edge of the printing medium, and taking over the count value of the first counter, based on a phase difference between the first signal and the second signal, for subsequent conveyance control for which the count value of the second counter is used.

8. An apparatus for conveying a sheet comprising:

a first conveyance roller for conveying the sheet;

a second conveyance roller, provided at a downstream side from said first conveyance roller with respect to a conveyance direction of the sheet, for conveying the sheet;

a first encoder for outputting a first signal in accordance with a rotation of said first conveyance roller;

a second encoder for outputting a second signal in accordance with a rotation of said second conveyance roller; and a control unit, having a first counter for counting pulses included in the first signal and a second counter for counting pulses included in the second signal, configured to control conveyance of the sheet on the basis of the count value of the first counter or the count value of the second counter, wherein in a case where the sheet is conveyed in a direction from said first conveyance roller to said second conveyance roller, said control unit switches from the count value of the first counter to the count value of the second counter for conveyance control, based on a position of the sheet, and upon switching, said control unit controls such that the count values of the first and second counters become equal based on a phase difference between the first signal and the second signal.

9. The apparatus according to claim 8, wherein upon the switching, said control unit controls such that the count value of said first counter is overwritten onto said second counter.

10. The apparatus according to claim 8, wherein said control unit detects: (1) a first time difference between one pulse included in one of the first and second signals and another pulse included in the other of the first and second signals immediately before the one pulse; and (2) a second time difference between the one pulse and still another pulse included in the other of the first and second signals immediately after the one pulse, and said control unit determines a shorter one of the first time difference and the second time difference as the phase difference.

11. The apparatus according to claim 8, wherein said control unit reflects the phase difference on a target stop position or timing for controlling in a subsequent conveyance after the switching.

12. The apparatus according to claim 11, wherein said control unit reflects the phase difference on the target stop position or timing for controlling in each of a plurality of subsequent conveyances after the switching.

13. An apparatus for conveying a sheet, comprising:

a first conveyance roller for conveying the sheet;

a second conveyance roller, provided at a downstream side from said first conveyance roller with respect to a conveyance direction of the sheet, for conveying the sheet;

a first encoder configured to output a first signal in accordance with a rotation of said first conveyance roller for obtaining conveyance information based on the first signal;

a second encoder configured to output a second signal in accordance with a rotation of said second conveyance roller for obtaining conveyance information based on the second signal; and a control unit, having a first counter for counting pulses included in the first signal and a second counter for counting pulses included in the second signal, configured to control conveyance of the sheet on the basis of the count value of the first counter or the count value of the second counter, wherein in a case where the sheet is conveyed in a direction from said first conveyance roller to said second conveyance roller, said control unit switches from the count value of the first counter to the count value of the second counter for conveyance control based on a position of a trailing edge of the sheet, and said control unit takes over the count value of the first counter, based on a phase difference between the first signal and the second signal, for subsequent conveyance control for which the count value of the second counter is used.

14. The apparatus according to claim 13, wherein upon the switching, said control unit controls such that a count value of said first counter is overwritten on said second counter.

15. The apparatus according to claim 13, wherein said control unit is configured to detect the phase difference between the first signal and the second signal, and said control unit reflects the phase difference on a target stop position or timing for controlling in a subsequent conveyance after the switching.

16. The apparatus according to claim 15, wherein said control unit detects: (1) a first time difference between one pulse included in one of the first and second signals and another pulse immediately before the one pulse included in the other of the first and second signals; and (2) a second time difference between the one pulse and still another pulse included in the other of the first and second signals immediately after the one pulse, and said control unit compares the first time difference with the second time difference to determine the phase difference.

17. The apparatus according to claim 15, wherein said control unit reflects the phase difference on the target stop position or timing for controlling in each of a plurality of subsequent conveyances after the switching.

18. An apparatus for conveying a sheet, comprising:

a first conveyance roller for conveying the sheet;

a second conveyance roller, provided at a downstream side from said first conveyance roller with respect to a conveyance direction of the sheet, for conveying the sheet;

a first encoder configured to output a first signal in accordance with a rotation of said first conveyance roller for obtaining conveyance information based on the first signal;

a second encoder configured to output a second signal in accordance with a rotation of said second conveyance roller for obtaining conveyance information based on the second signal; and a control unit, having a first counter for counting pulses included in the first signal and a second counter for counting pulses included in the second signal, configured to control conveyance of the sheet on the basis of the count value of the first counter or the count value of the second counter, wherein in a case where the sheet is conveyed in a direction from said first conveyance roller to said second conveyance roller, said control unit switches a signal used for conveyance control from the first signal to the second signal based on a position of a trailing edge of the sheet, and said control unit takes over the count value of the first counter, based on a phase difference between the first signal and the second signal, for subsequent conveyance control for which the count value of the second counter is used, and said control unit reflects the phase difference on a target stop position or timing for controlling in each of a plurality of subsequent conveyance after the switching.

19. The apparatus according to claim 18, wherein said control unit detects: (1) a first time difference between one pulse included in one of the first and second signals and another pulse included in the other of the first and second signals immediately before the one pulse; and (2) a second time difference between the one pulse and still another pulse included in the other of the first and second signals immediately after the one pulse, and said control unit compares the first time difference with the second time difference to determine the phase difference.

* * * * *